US006752100B2

(12) United States Patent
Guinn et al.

(10) Patent No.: US 6,752,100 B2
(45) Date of Patent: Jun. 22, 2004

(54) APPARATUSES AND METHODS OF DEPLOYING AND INSTALLING SUBSEA EQUIPMENT

(75) Inventors: Roy Mitchell Guinn, Houston, TX (US); Denby Grey Morrison, Houston, TX (US); Christian A. Cermelli, Houston, TX (US); John H. Pelletier, Houston, TX (US); Hugo A. Corvalan San Martin, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/156,713

(22) Filed: May 28, 2002

(65) Prior Publication Data

US 2003/0221602 A1 Dec. 4, 2003

(51) Int. Cl.[7] ..... B63B 35/44
(52) U.S. Cl. ..... 114/258; 166/355
(58) Field of Search ..... 114/258; 166/355; 175/27

(56) References Cited

U.S. PATENT DOCUMENTS 5,190,107 A * 3/1993 Langner et al. ..... 166/355
5,480,521 A * 1/1996 Snyder et al. ..... 205/731

* cited by examiner

*Primary Examiner*—Jesus D. Sotelo
(74) *Attorney, Agent, or Firm*—J. M.(Mark) Gilbreth; Mary A. Gilbreth; Gilbreth & Associates, P.C.

(57) ABSTRACT

The invention describes a cost-effective alternative for deploying and installing subsea equipment using a workboat or other vessel of opportunity. The equipment is not supported directly by the vessel, but is instead supported by one or more buoys below the wave zone. The buoys are controlled by a combination of chain, wire rope, and synthetic line linking it to the workboat. As such, the buoy system described herein decouples vessel motion from the payload by supporting the payload from the buoys below the wave zone. Because the buoys are below the wave action and its associated turbulence, there is little energy and hence little tendency for motion. The result is a stable, inexpensive, maneuverable system capable of servicing large subsea payloads in a wide range of water depths.

7 Claims, 27 Drawing Sheets

APPARATUSES AND METHODS OF DEPLOYING AND INSTALLING SUBSEA EQUIPMENT

FIELD OF THE INVENTION

This invention generally relates to apparatuses and methods of deploying and installing subsea equipment. More particularly, the present invention relates to wet parking, moving of, deployment, launching, and wet installation of subsea equipment.

BACKGROUND OF THE INVENTION

Most subsea production systems are equipped with smaller components designed to be recovered and replaced using less expensive, non-invasive intervention techniques. These components include subsea control pods, specially designed valve and choke trim and actuators, pipeline maintenance and repair equipment, and fluid distribution modules. These components are typically designed to be placed and recovered by a free-swimming remotely operated vehicle (ROV) intervention system which is operated from a large support vessel. These subsea components usually require a soft landing on the manifold because of delicate components or interfaces.

Because of the need for a soft landing, the deployments system is usually mounted on a large, stable vessel such as a semi-submersible drilling rig or derrick barge. Smaller workboats are rarely used because their heave motion, even in modest seas, poses significant risk to the subsea equipment during loading, offloading, launching, landing, and recovery operations. Unfortunately, the high cost and questionable availability of large offshore vessels may prohibit their use.

As the need for new sources of oil and gas push operations into deeper water, such operations will increasingly require exacting placement of even larger and heavier subsea equipment and work packages 5,000 feet or more below the ocean's surface.

The size and mass of the subsea equipment and the water depth absolutely precludes the use of divers. Similarly, the size and mass of many work packages precludes direct placement with ROVs. Buoyancy modules might assist ROV operations, but the mass of the work packages and the size of their required buoyancy may nevertheless preclude primary positioning operations with ROVs.

Directly lowering the subsea work package from a surface vessel on cables or other lines is well suited to accommodate the size and mass of large work packages. However, normal sea conditions subject the vessel to heave, thereby causing the vessel to fall and rise with the passing waves. Absent an effective active heave compensation system, the vessel's motion is transmitted directly through the line to the subsea work package. This uncontrolled vertical motion proves unsatisfactory for many applications and has prevented final efforts by ROVs to guide and land the subsea work packages so presented.

Attempts have been made to dynamically compensate for the heave at the line, either by driving hydraulic rams or by driving a winch as necessary to take in or pay out line to maintain the subsea work package substantially stationary despite movement of the vessel. However, such systems are expensive, complex, subject to substantial maintenance requirements, and require delicate balance to operate effectively. Moreover, analysis has shown that deeper depths and heavier loads make these approaches to heave compensation ineffective. As is the case with smaller components, the alternative has been to avoid heave compensation systems and use semi-submersible drilling rigs or derrick barges for deployment of larger components. For example, the traditional way of deploying subsea trees and other hardware has been to use drill pipe deployed through the rig moonpool. This method ensures good uptime as heave motions are kept to a minimum on the very stable rig platform while package motions are not amplified dynamically due to the high stiffness of the drill pipe. On the other hand, the cost for using these large, stable vessels is extremely high for activities other than drilling and completing wells.

Accordingly, there remains a substantial need for a solution to the problem of placing heavy yet delicate subsea work packages in deepwater that is simple, straightforward, less costly, and otherwise suitable for real application in the offshore working environment.

SUMMARY OF THE INVENTION

The present invention is directed to apparatuses and methods of deploying and installing subsea equipment.

In one embodiment, the apparatus comprises a pendant line connecting the subsea equipment to a subsurface buoy; a deployment line having a catenary loop below the subsurface buoy, the deployment line being supported by the subsurface buoy on one end and connected to a surface vessel on the other end, the subsea equipment, subsurface buoy, pendant line, and deployment line cooperating to establish a natural frequency for the suspended subsea equipment which is materially different from the average wave frequency acting on the surface vessel; and a parking pile partially embedded in the sea floor, on which the subsea equipment may be parked.

In another embodiment, a method for positioning a subsea work package at a desired deepwater offshore location is described. The method includes launching a parking pile from a transport vessel; lowering the pile to the sea floor with a hoisting line; and then releasing the pile from the hoisting line such that the pile partially embeds itself into the sea floor. The method next includes launching the subsea work package from a transport vessel; lowering the subsea work package to the sea floor with a combination of wire, chain, clump weights, subsurface buoys, and synthetic line; and parking the subsea work package on the partially embedded pile. The parked subsea work package can then be moved to an operating location when desired.

The present invention also includes a method for positioning a subsea work package at a desired deepwater offshore location where the subsea work package is mounted to a parking pile. The combined parking pile and subsea package are launched from a transport vessel, lowered to the sea floor with a hoisting line; and then released from the hoisting line such that the pile partially embeds itself into the sea floor. If desired, a protective frame to surround the mounted subsea work package can be provided. Alternatively, a launching frame for launching the parking pile and subsea package from the transport vessel can be provided. Once parked, the subsea work package can be moved to a distant operating location.

The foregoing summary has outlined rather broadly the features and technical advantages of the present invention so that the detailed description of the invention that follows may be better understood. Additional features and advantages of the invention will be described hereinafter, which form the subject of the invention. It should be appreciated by those skilled in the art that the conception and the specific embodiments disclosed might be readily used as a basis for modifying or designing other apparatuses and methods for carrying out the same purposes of the present invention. It should also be realized by those skilled in the art that such equivalent constructions do not depart from the spirit and scope of the invention as set forth and claimed herein.

BRIEF DESCRIPTION OF THE DRAWINGS

The accompanying drawings, which are incorporated in and form a part of the specification, illustrate the embodiments of the present invention, and, together with the description, serve to explain the principles of the invention. In the drawings:

FIGS. 28 and 29 are comparisons of heave RAOs for different support vessels in head & quartering seas (FIG. 28) and beam seas (FIG. 29).

It is to be noted that the drawings illustrate only typical embodiments of the invention and are therefore not to be considered limiting of its scope, for the invention will admit to other equally effective embodiments.

DETAILED DESCRIPTION OF THE INVENTION

In general, the present application describes a cost-effective alternative for deploying and installing subsea equipment using a workboat or other vessel of opportunity. The equipment is not supported directly by the vessel, but is instead supported by one or more buoys below the wave zone. The buoys are controlled by a combination of chain, wire rope, and synthetic line linking it to the workboat. As such, the buoy system described herein decouples vessel motion from the payload by supporting the payload from the buoys below the wave zone. Because the buoys are below the wave action and its associated turbulence, there is little energy and hence little tendency for motion. The result is a stable, inexpensive, maneuverable system capable of servicing large subsea payloads in a wide range of water depths.

Figure 1:
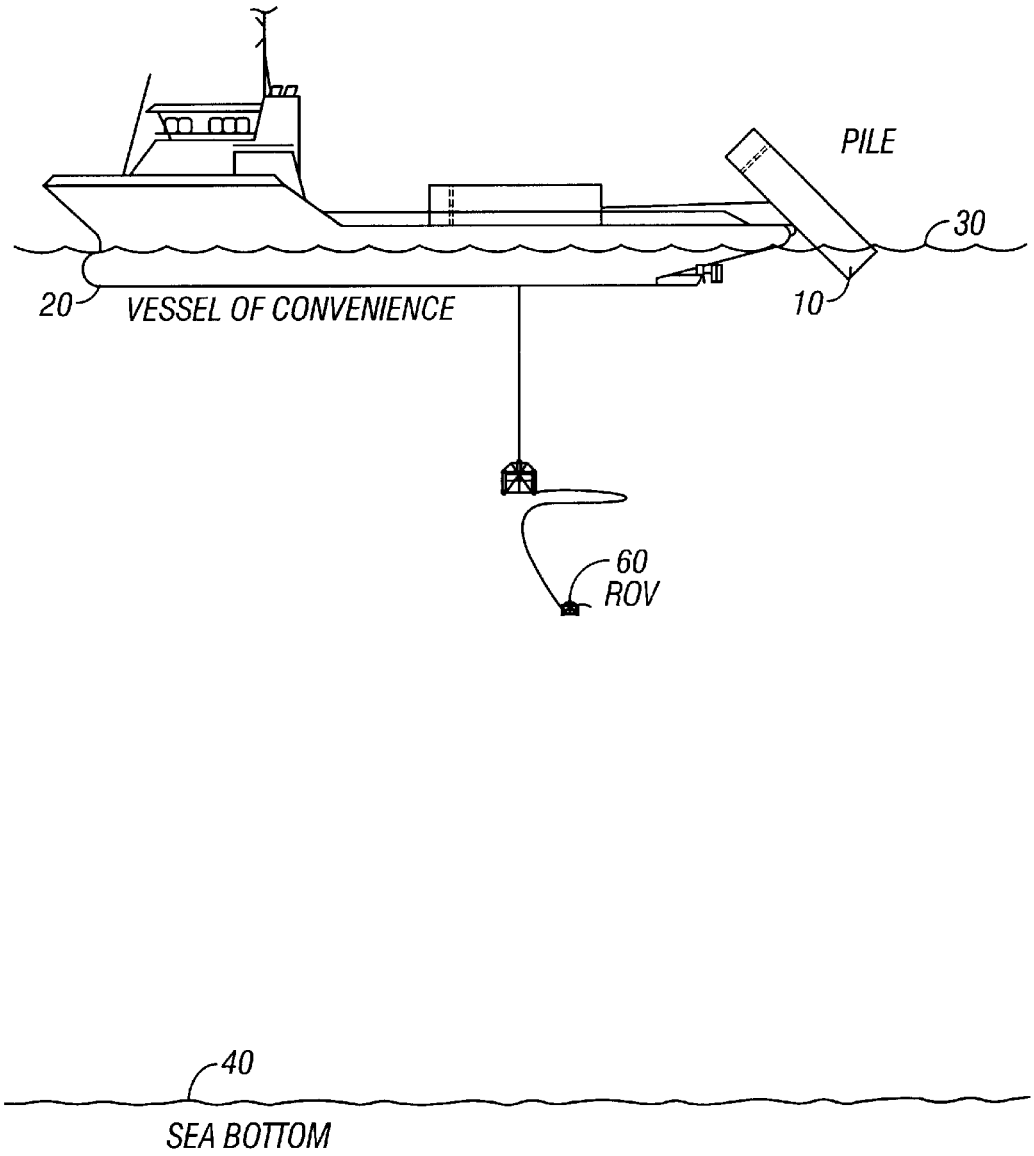
FIGS. 1–3 are side elevation views of a parking pile being launched from a transport vessel, lowered to the sea bottom, and released and bedded in the sea bottom.
Figure 2:
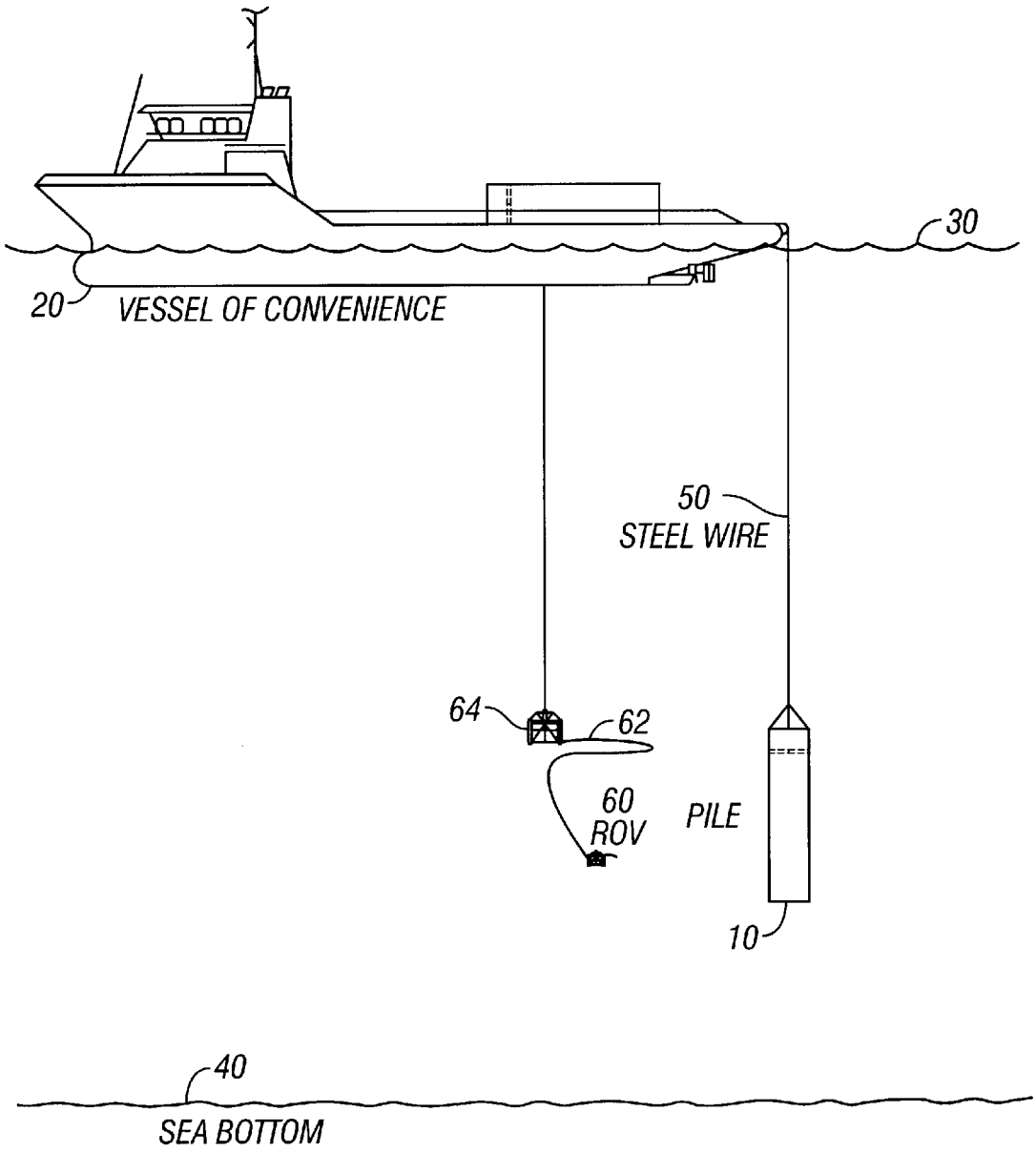
Figure 3:
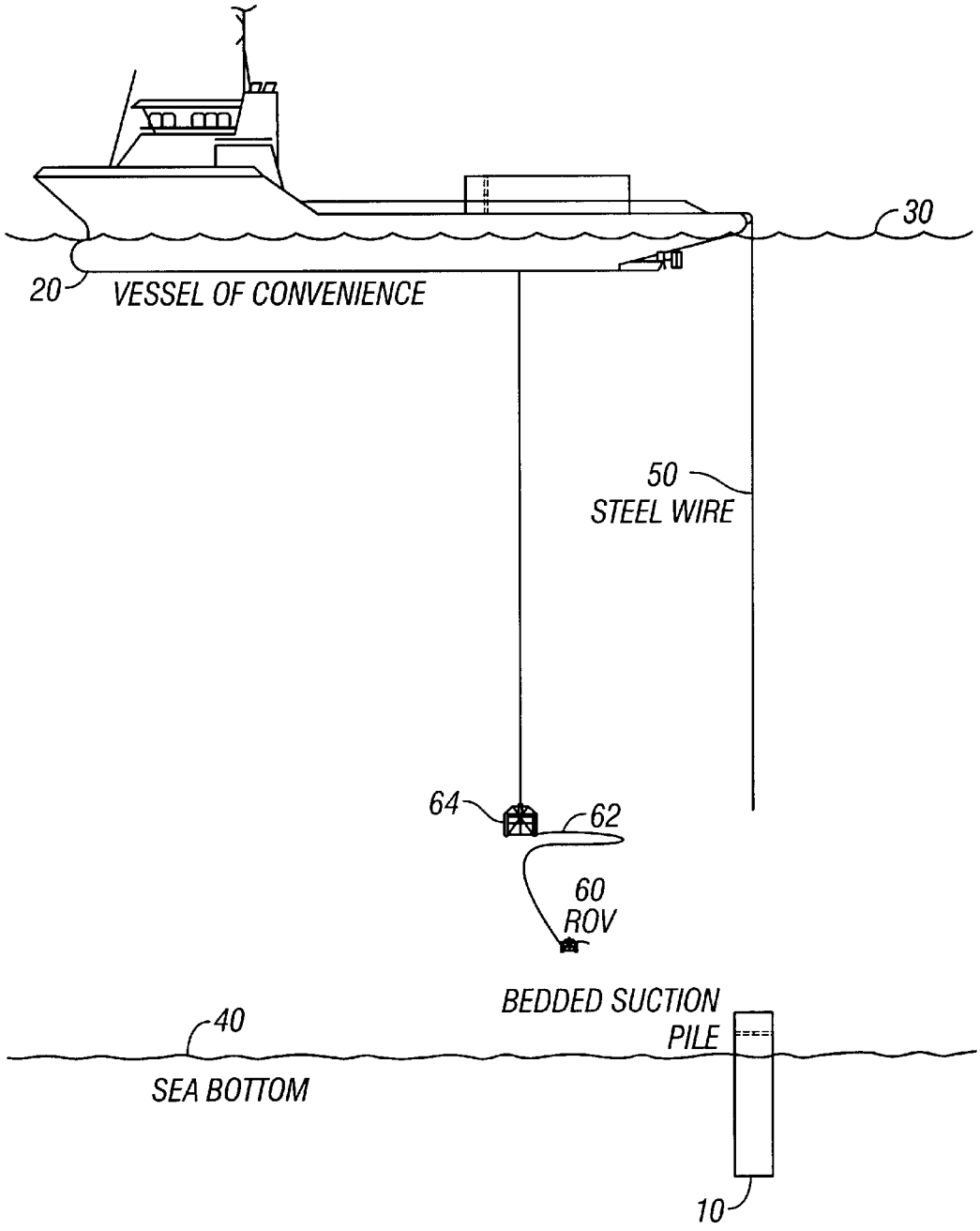

Referring now to FIGS. 1–3, there are shown the basic steps in deploying and bedding a parking pile 10 of the present invention. The parking pile 10 is launched from the deck of a surface or transport vessel or other vessel of convenience 20 such as a workboat, barge, drill ship, or semi-submersible vessel. The parking pile 10 is lowered from the surface 30 of the water to the sea bottom 40 by a winch with a hoisting line 50, such as a steel wire, over the stern of the vessel 20. The hoisting line 50 is preferably 3½ inch 6-strand wire rope, with a breaking strength around 600 tons in this particular case, with specific loads being handled (for other loads the diameter and breaking strength could be different). As the parking pile 10 nears the sea bottom 40, it is released from the wire 50 (for example, by an ROV-activated release mechanism), and then partially embeds itself into the sea bottom 40.

Preferably, the parking pile 10 weighs from about 30 tons to about 60 tons, has a diameter from about 8 feet to about 12 feet, and is from about 20 feet to about 120 feet in length. When embedded in the sea floor, from about 5 feet to about 10 feet in length of the parking pile is above the sea floor mud line. The piles are usually stiffened steel tubular sections (pipes) but could also be of different sections and materials capable of carrying the loads and penetrating the sea floor. For example, it may also have the package (THS or tree) attached to the top of the parking pile, in which case the pile is longer and larger in order to have the correct penetration into the sea floor, as well as provide sufficient clearance of the package above the sea floor on final penetration. Depending upon the need, more than one of these suction piles 10 can be deployed to the sea bottom 40 to form a wet parking system. As might be expected, some engineering modifications to the suction piles are needed to allow for the attachment of the subsea equipment. For example, a different location and orientation for the pumping path and the exit path for the suction pile may be needed. Moreover, a solid plate or perforated plate (or similar device) may be added to the suction pile to arrest penetration into the subsea floor.

If desired, a remotely operated vehicle (ROV) 60, which swims on an umbilical 62 from a cage 64, can be deployed from the vessel 20 and used to monitor or assist with the launching, lowering, releasing, or embedding of the parking pile 10. The ROV 60 provides visual feedback to the operators, final guidance of the payload, and can operate any latch and release mechanisms.

When one or more parking piles 10 are bedded in the sea bottom 40, a variety of subsea equipment or other payloads, such as a subsea tubing hanger spool 70 or a subsea well tree 80, may be installed or "parked" on the piles 10. These loads or packages may be landed on the parking piles separately, or launched attached with the parking piles. A suitable interface between the subsea equipment and the parking pile is provided. For example, the top of the parking pile may have a modified stump profile adapted to whatever subsea package is sent down. A standard tubing hanger spool incorporates upward facing or funnel up tops and downward facing or funnel down bottom interfaces. Its weight in air is approximately 30 short tons. The tubing head spool provides a transition between the wellhead housing and the Christmas tree, as well as a transition from the subsequently installed tree production flow-loop and well jumper via a U-loop assembly. The subsea well tree is landed on the tubing head and weighs approximately 40 short tons in air.

Figure 4:
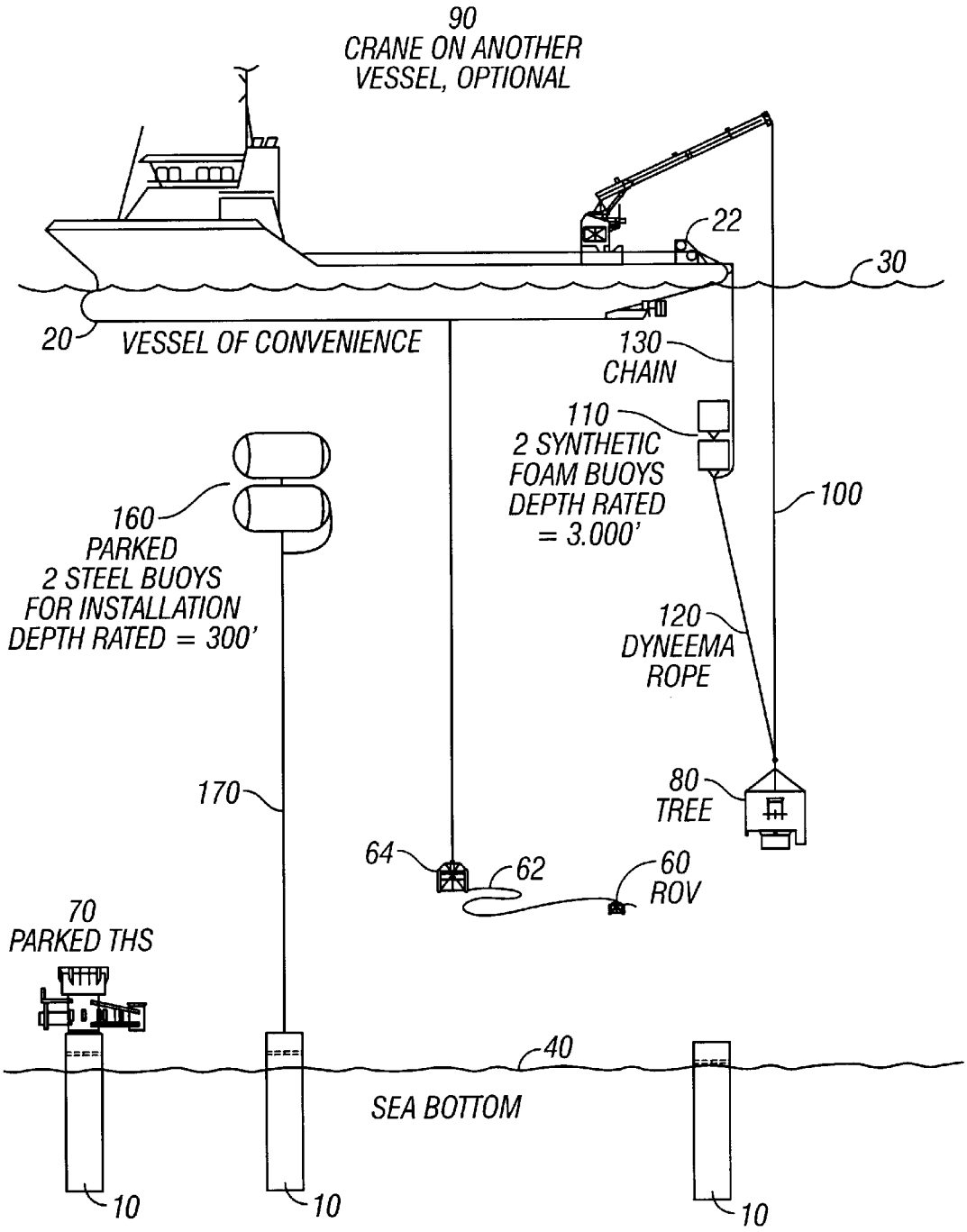
FIGS. 4–6 are side elevation views of a subsea well tree or any other payload being launched from a vessel, lowered to the sea bottom, and parked on a parking pile.
Figure 5:
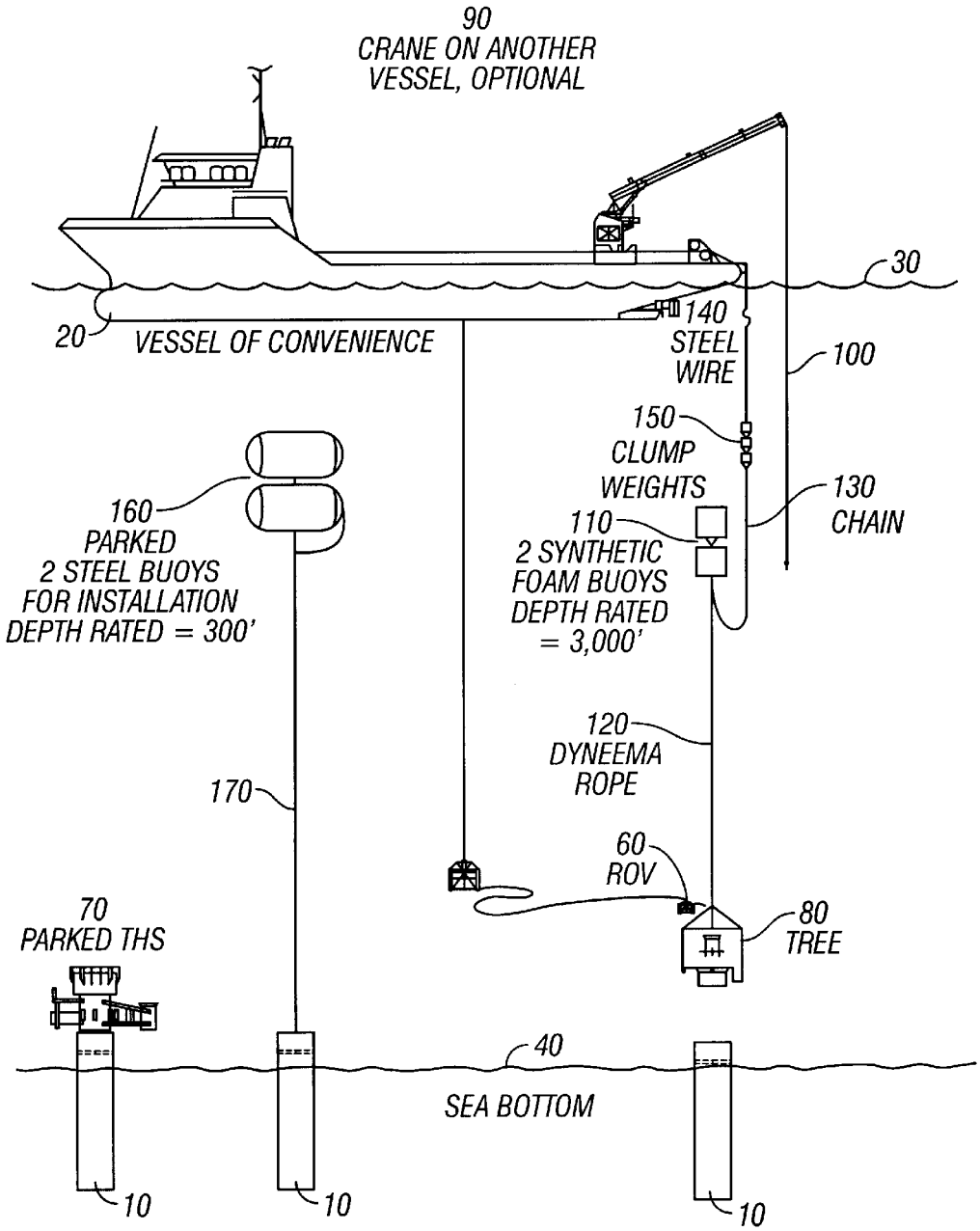
Figure 6:
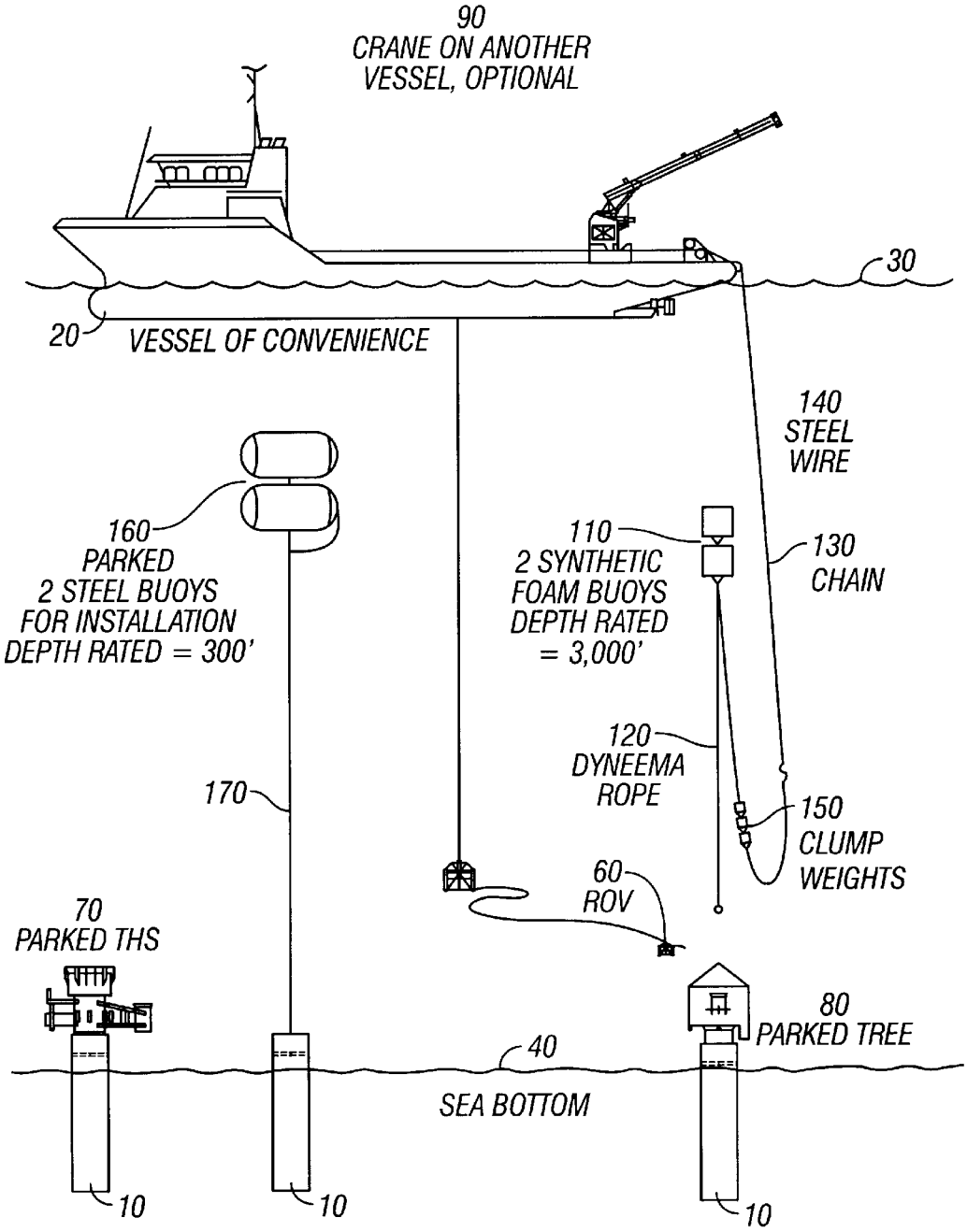

By way of example, FIGS. 4–6 illustrate the basic steps in parking a subsea well tree 80 or any other payload on a parking pile 10. In FIG. 4, the subsea tree 80 is attached to an overboarding line 100, such as a steel wire (preferably a 3½ inch diameter wire with approximately 600 ton breaking load). The tree 80 is lowered into the water with the aid of a boom crane 90. The boom crane 90 may be located on the deck of the vessel 20 or on another vessel of convenience.

Alternatively, a large A-frame can be used to overboard the package into the water off the stern or through a moonpool in the deployment vessel. The tree 80 is supported in the water by one or more synthetic foam subsurface buoys 110 which are attached to the subsea tree 80 by a pendant line 120. The pendant line 120 must be strong enough to support the subsea payload and its own line weight with a significant safety margin to allow for wear and/or dynamic loads. While many different materials can be selected, the pendant line 120 is usually a steel wire or a high strength synthetic fiber rope such as HMPE (dyneema) rope or a combination of the two joined by 55-ton shackles. Preferably, the pendant line is 3-inch dyneema rope available from Marlow Superline. Dyneema rope is known for its relatively light weight (approximately 9 times less than steel), being almost neutrally buoyant, and having a slightly smaller elastic modulus (approximately 3 times smaller). Moreover, an important advantage of synthetic fiber (HMPE, dyneema, or polyester) over steel wire is the overall payload reduction including rope, winches, and supporting infrastructure for deployment.

In FIGS. 4–6, the subsurface buoys 110 that are used to initially install the subsea equipment are synthetic foam buoys depth rated from about 3,000 to about 5,000 feet. As is known to those skilled in the art, the use of a deep buoyancy design allows for a correspondingly short steel pendant line so that the weight of the pendant is minimized and the total carrying capacity of the buoys is not affected. The buoys 110 support the well tree 80, the pendant line 120, and part of the chain weight 130, described below. They operate below the wave zone and ideally below the surface current. The actual location of the buoys in the water column is a trade-off between the overall system performance and the cost of buoyancy to resist large hydrostatic pressure. Each of the buoys 110 is about 13 feet tall and 8 feet in diameter and weighs about 12,700 lbs dry. Each buoy provides about 60 kips of buoyancy in seawater. Each buoy is preferably surrounded by a metal protective cage, such as a pipe frame, to prevent chaffing from the chain motion. The required buoyancy is the sum of the payload weight, running tool and associated rigging weight, pendant wire weight, submergence allowance, and trim allowance chain weight.

The subsurface buoys 110 are attached to the vessel 20 by a deployment line 140, such as a steel wire, and a length of chain 130, which forms a catenary loop between the wire 140 and the buoys 110. Depending upon the depth involved, the length of the deployment line 140 is from about 3000 feet to about 4000 feet, and the length of the chain 130 is from about 1500 feet to about 2000 feet. The deployment line 140 must be strong enough to support the chain weight and its own line weight with a significant safety margin to allow for wear and/or shock loads. Also, one must consider hydrodynamic drag from the buoy in a worst-case scenario where the chain is entangled with the buoy and the system is uncompensated. Most preferably, the deployment line 140 is 3½ inches diameter wire rope with a breaking strength around 600 tons. As is known to those skilled in the art, the stiffness of the line, which is a function of rope size (diameter), material (steel or synthetic fiber), and type of construction (such as 6 or 8 strand wire and/or spiral strand or plaited construction), may be varied depending upon the operating conditions. Moreover, the recommended practices for deployment lines suggests larger factors of safety ranging from 6 to 8 and even 10 due to the highly dynamic nature of load lifting and the frequent cyclic reeling of the line over sheaves which accumulates fatigue damage as well as significant wear and tear.

The chain 130 serves many purposes. The chain "belly" allows the workboat or vessel 20 to heave independently of the buoys. As the vessel stem heaves up and down, the neutral point in the chain belly shifts and transfers chain weight to and from the buoy. This load transfer could theoretically cause the buoys to move up and down, defeating the purpose of the present invention. This type of motion, however, can be eliminated by engineering the heave compensated landing system around the resonant periods of each sub-system. When properly designed, the chain load is transferred to and from the buoys too quickly for the buoys/payload to respond. This effectively de-couples the buoys from the vessel. Specific attention must be paid to the environmental conditions. Also, because the chain's weight is supported by both the buoys and the vessel, the buoys will naturally come to equilibrium with the sum of its buoyancy, payload, and partial chain weight. Thus the chain automatically facilitates trim adjustment for small weight inaccuracies.

In addition, the chain 130 is needed to provide enough weight at the end of the deployment line 140 to avoid slack line conditions during fully deployed dynamic responses, to avoid "snap loading" during retrieval, and to avoid excessive lateral excursion during high current loads. The size of the chain 130 allows for designer's prerogative. The larger the size, e.g. 3-inch versus 2-inch chain, the shorter the required length. One or more clump weights 150 can also be used to reduce the total length of chain required. Of course, it is possible to use different size chains in the same system, subject to well-defined package weights and buoyancy. Different chain sizes, however, are significantly more difficult to handle and store on board the surface vessel.

Selecting the chain size and weight requires establishing a balance between optimizing the chain "belly" below the buoys and de-coupling the buoys from the boat. The chain size should facilitate a reasonable belly length, be easily handled on the deck, and be fairly light. Preferably, the chain is 3¼-inch chain with a dry weight of about 59-lb/ft chain and is used in a section of from about 1000 feet to about 2000 feet long.

It is preferred that swivels, such as 45-ton eye-and-eye swivels, be used to compensate for rotation of the wires, lines, and chain. Preferably, swivels are used at each rope or wire connection point to manage twisting, kinking, and entanglement of the ropes. Standard wire rope is not torque-balanced and will twist as load is applied and relaxed. In the case of the present invention, which employs thousands of feet of wire, this can cause twisting and entanglement of the subsea equipment. Torque-balanced wire is available, but is expensive and usually not 100% balanced. Swivels placed into select points allow the wire to react without entangling the system. Ball bearing swivels are preferred because of their low turning friction.

A winch or draw works 22 near, or deploying over, the stem of the surface vessel 20 is used to raise or lower the deployment line 140 and the overboarding line 100. Various configurations are possible, and depending on the availability and capacity of a stern-mounted A-frame, the lines could run off an A-frame using a double drum winch unit. The system requires a large drum capacity to handle large amounts of wire and chain, and high speed to transit to and from the sea bottom. Anchor handling winches generally meet these requirements. Once submerged, the load is transferred from the overboarding line 100 to the pendant line 120 and buoys 110. An ROV 60 then releases the overboarding line 100. The operation can be repeated for each component. By way of illustration, in FIG. 5, the overboarding steel wire 100 is released, such that the subsea tree 80 is connected to the vessel 20 through the deployment steel wire 140, chain 130, buoys 110, and pendant rope 120.

The weight of the catenary loop of the chain 130 is shared between the subsurface buoys 110 and the surface vessel 20 and the depth of the subsurface buoys is controllable in part through the deployment line by adding significant weight to the catenary loop. For example, one or more clump weights 150 may be added to the chain 130. Preferably, the clump weights 150 are about 20,000 lbs to 30,000 lbs each. Clump weights significantly reduce the length of chain required, and associated handling and storage thereof. The clump weights are also used to compensate the weight of the package when it is released and to lift and lower the buoys collaborating with the chain "belly." In FIG. 6, the clump weights move around the "belly" to be carried by the buoys 110, thereby compensating for the load of the subsea tree 80 being transferred to the parking pile 10, thereby lowering and engaging the subsea tree 80 on top of the parking pile 10. An ROV 60 can be used to monitor the lowering of the subsea equipment, park the subsea equipment on the pile 10, and provide means for releasing the overboarding line 100 or the pendant line rope 120 from the equipment or payload.

FIGS. 4–6 also show a subsea tubing hanger spool parked on its own parking pile 10 and one or more "parked" subsurface steel buoys 160 which are attached or tethered to a different parking pile 10 by dyneema rope 170. Here, the buoys 160 are steel buoys depth rated from about 300 to about 500 feet, well below the subsurface wave zone. These are 50 kip buoyancy steel cylinders with ellipsoidal heads filled with air. Each of the buoys 160 is approximately 18 feet tall and 10 feet in diameter and weighs about 12,700 lbs. dry. Each buoy provides about 50 kips of buoyancy in seawater. One potential source for these submersible buoys is Delmar's steel submersible buoy design. To prevent chaffing from the chain motion, smooth steel buoys are preferred. Instead of being tethered to a parking pile alone, the buoys 160 may also be tethered to a variety of parked subsea equipment. As is known to those skilled in the art, the use of a near surface buoyancy design allows for a correspondingly very long pendant line. Again, the actual depth of the buoy is a trade-off between system performance and the cost of buoyancy. For instance, a shallow buoyancy case would have a relatively long pendant line that could eventually lead to significant dynamic response. On the other hand, the advantage of the shallow-buoy system would be in the expense of the buoy relative to a deep-water deployment buoy.

Figure 7:
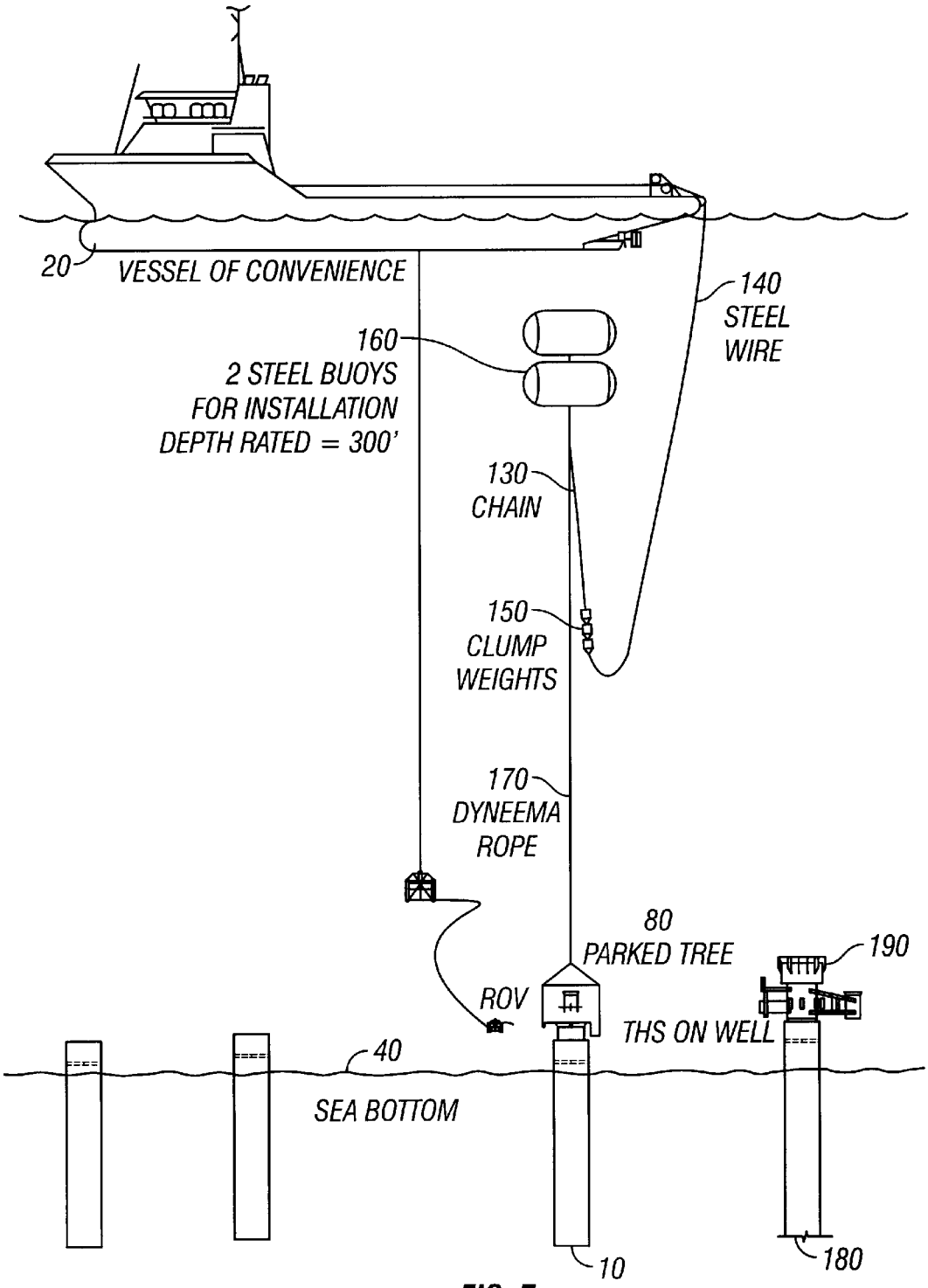
FIGS. 7–9 are side elevation views of a parked subsea well tree or any other payload being moved from a parking pile to a distant operating location.
Figure 8:
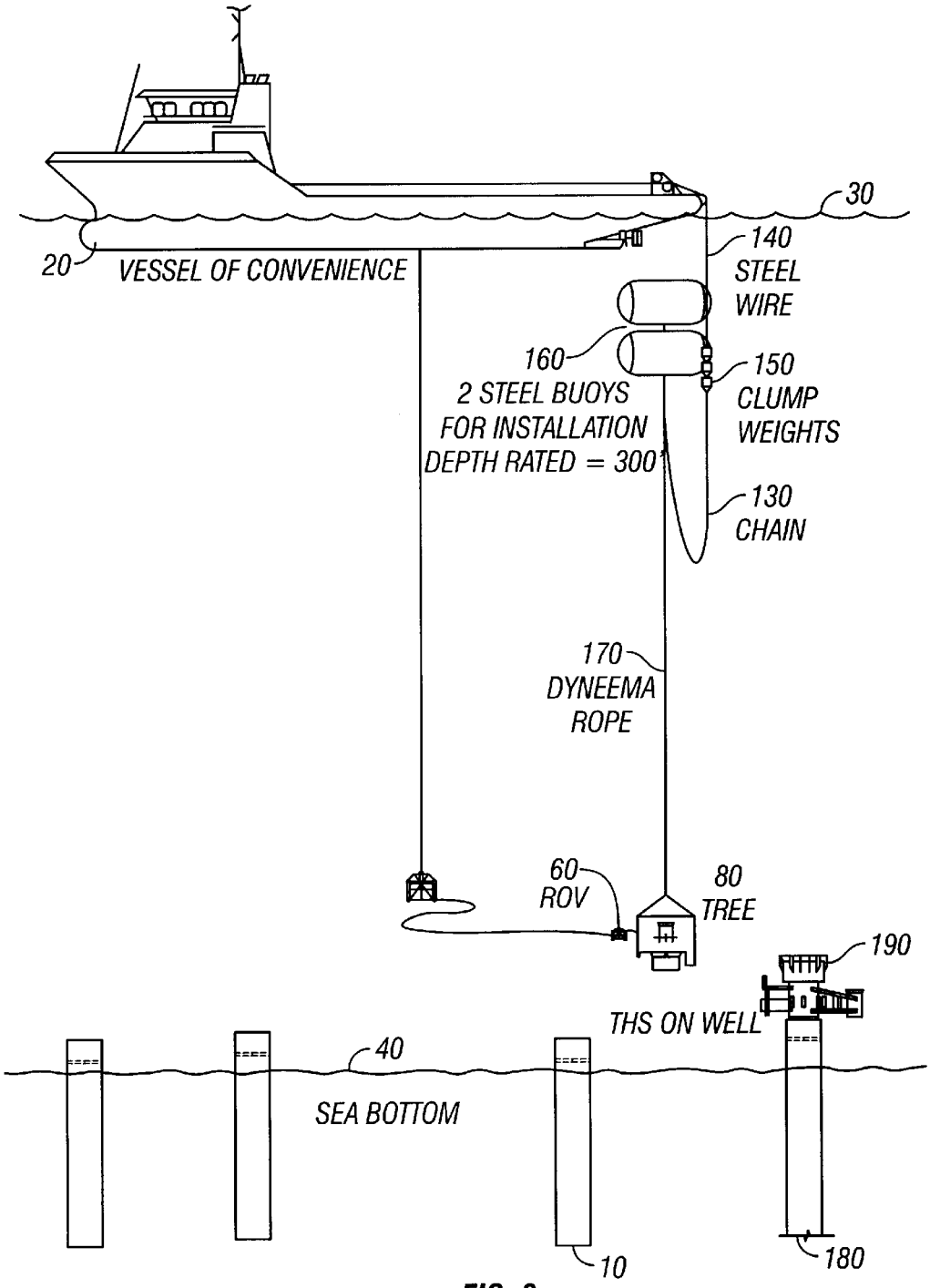
Figure 9:
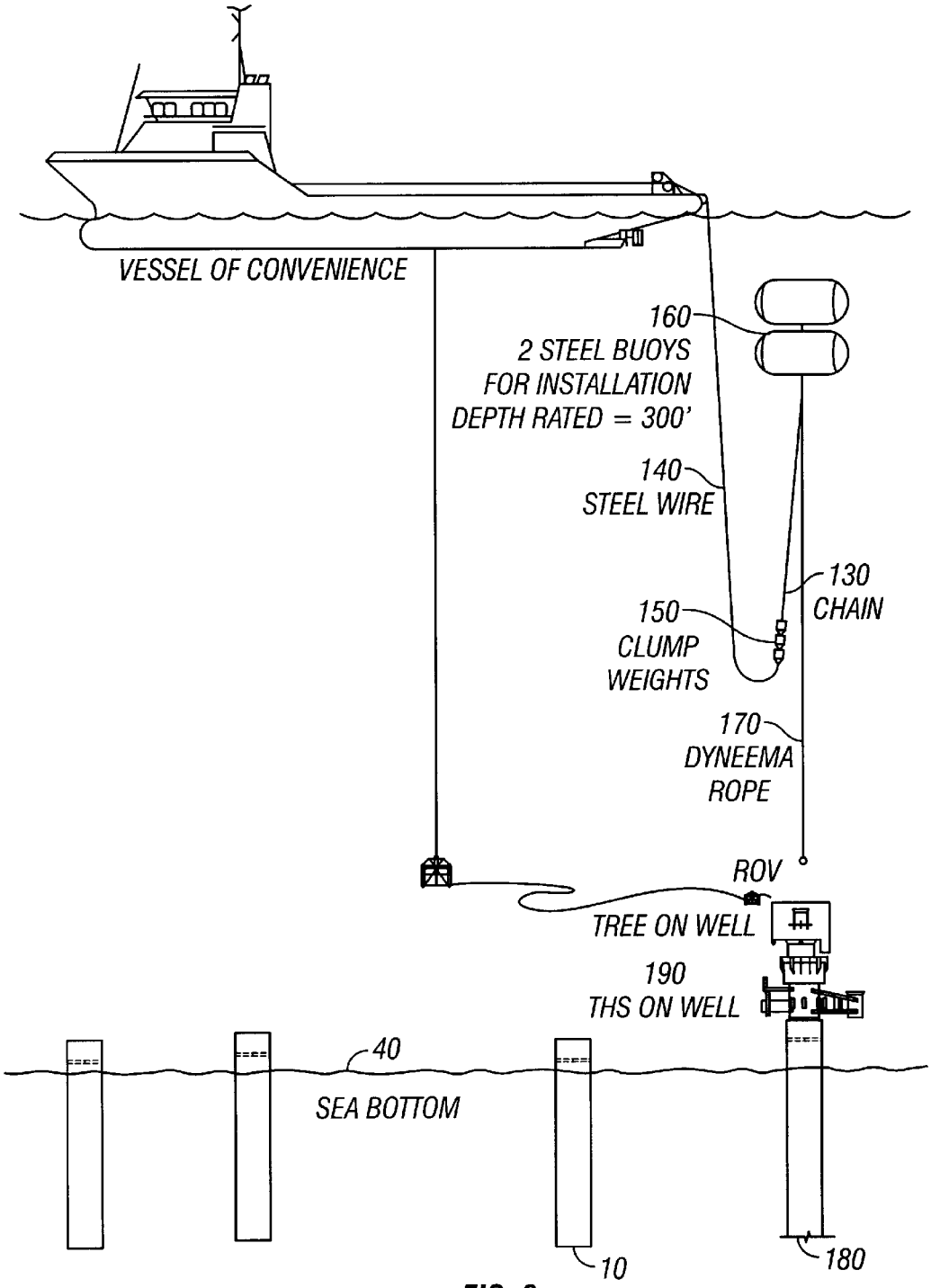
Figure 10:
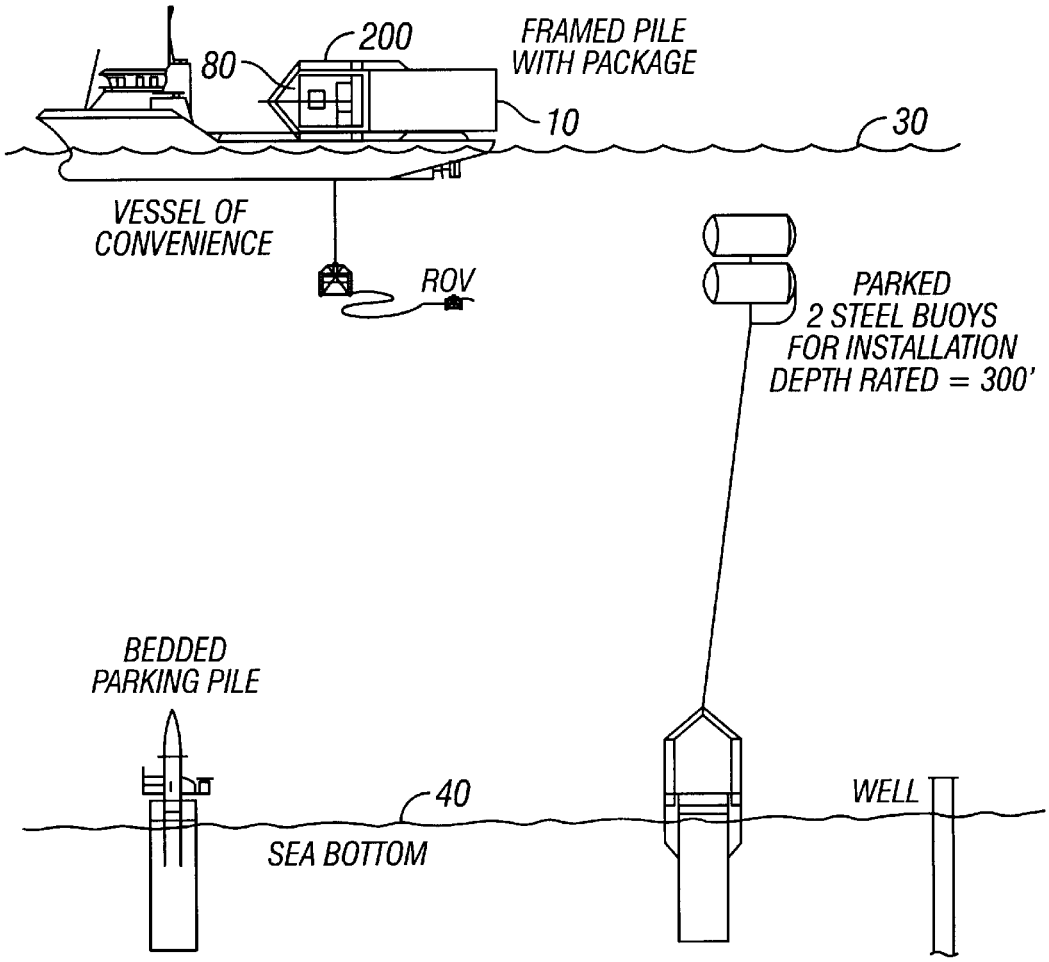
FIGS. 10–15 are side elevation views of subsea equipment integrally mounted to a framed parking pile being launched, lowered to the sea bottom, and released and bedded together as a unit in the sea bottom.
Figure 11:
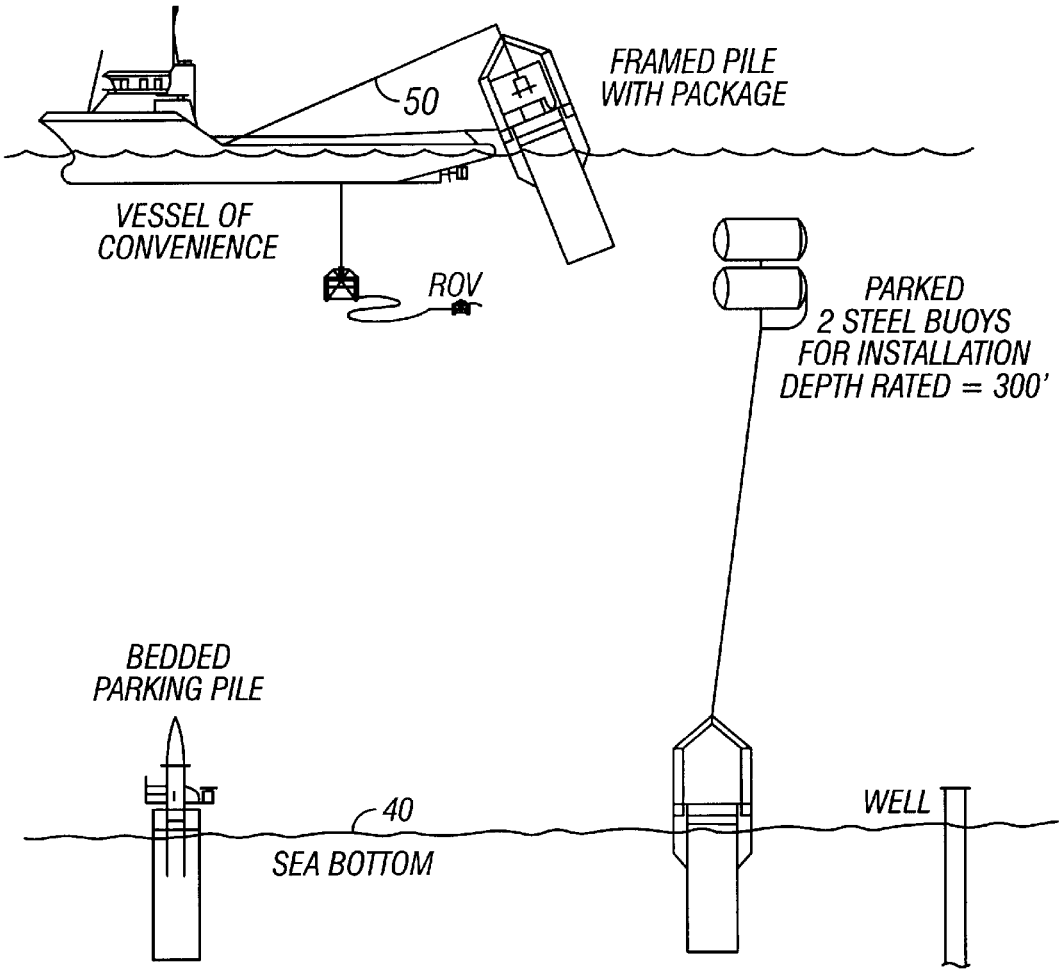

Turning now to FIGS. 7–9, there are shown the basic steps in moving a previously parked piece of subsea equipment to a desired operating location, such as a wellhead 180. The distance from the parking pile to the operating location could be as short as a few feet to several hundred feet, preferably 300 feet. This distance provides sufficient clearance to account for vessel sizes, adjacent mooring lines, environmental loads, and the like, so as to avoid collisions.

Specifically, in FIG. 7, a subsea tree 80 is parked on a parking pile 10. One or more steel buoys 160, such as a 50 KIP buoy, are tethered to the parked tree 80 with a pendant line 170, such as dyneema rope. While many different materials can be selected, the pendant line 120 is usually a steel wire or a high strength synthetic fiber rope such as dyneema rope or a combination of the two joined by shackles and swivels. Preferably, the pendant line is a combination of 200 feet of 2¼-inch wire rope, 600 feet of HMPE rope, and 5500 feet of HMPE rope joined by 55-ton shackles with 45-ton eye-and-eye swivels. The pendant line may be terminated near the sea bottom with a 3-inch lifting ring from which three 30 feet sections of 1½ inch wire ropes disperse to provide a lifting sling or three "spaced" connection points with the subsea equipment. When it is desired to move the subsea tree 80 to a tubing hanger spool 190 mounted to the wellhead 180, the chain 130, steel wire 140, and clump weights 150 (all described above) are lowered from the vessel 20 and attached to the bottom of the steel buoys 160. As before, the short chain 130 (from about 50 feet to about 400 feet, preferably 155 feet of 3¼ inch chain) is attached to the buoys 160 and hangs to form a "belly" before rising to the vessel 20. This allows the workboat or vessel 20 to heave independently of the buoys 160.

In FIG. 8, the steel wire 140 is then raised or winded up toward the vessel 20. As the clump weights 150 approach the depth of the steel buoys 160, the buoys begin to float toward the surface 30 of the water, thus lifting the subsea tree 80 from the parking pile 10. With the assistance of an ROV 60, the subsea tree 80 can then be moved close and steady above the tubing hanger spool 190. While only one ROV is shown in the drawings for monitoring and releasing the payloads, additional ROVs can be used in the present invention to monitor other subsea activities, such as the interaction of the chain 130 and the pendant line 170 with the buoys 160. As such, a combination of working class and observation class ROVs may be used with the present invention.

In FIG. 9, the deployment line or steel wire 140 is lowered or payed out causing the buoys 160 to fall to equalize the load. With the assistance of the ROV, the subsea tree 80 is then engaged or mounted on the tubing hanger spool 190. Chain 130 and clump weights 150 will move around under the buoys in order to take the load of the tree off the pendant line and buoys 160, allowing the tree to be carried fully by the wellhead 180. The ROV 60 can also be used to release the pendant line or dyneema rope 170 from the tree 80.

Another embodiment of the wet parking system of the present invention is pictured in FIGS. 10–15. Instead of bedding the parking piles and then "parking" the subsea equipment in two steps, the subsea equipment may be integrally mounted to the parking pile (while on the vessel), and then horizontally launched, lowered through the water column, and bedded together as a unit into the sea bottom.

In this embodiment, the subsea equipment, such as a subsea tree 80, is protected within a metal frame 200 attached to the upper portion of the parking pile 10. The metal frame 200 surrounds the subsea equipment and protects its delicate components or interfaces. The frame 200 is used as hinge structure when overboarding and also serves as protection to sensitive equipment components such as piping, controls, seals, control panels, ROV interfaces, and the body of the equipment itself. As before, the combined parking pile 10 and subsea well tree 80 or other payload is launched from the deck of a transport vessel 20 and lowered from the surface 30 of the water to the sea bottom 40 with a hoisting line or steel wire 50. If desired, mass traps may be added to the hoisting line and lowering line axial properties can be engineered to achieve the desired strength and dynamic response properties.

Figure 12:
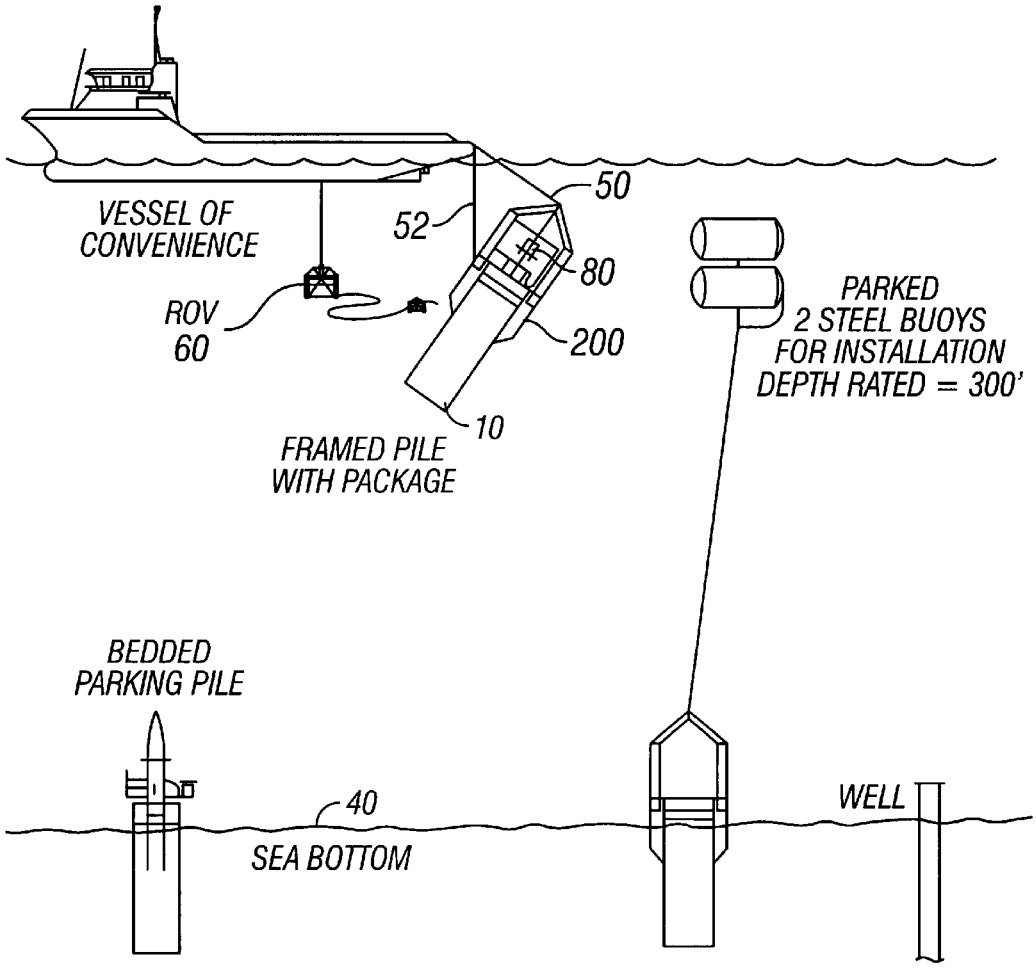
Figure 13:
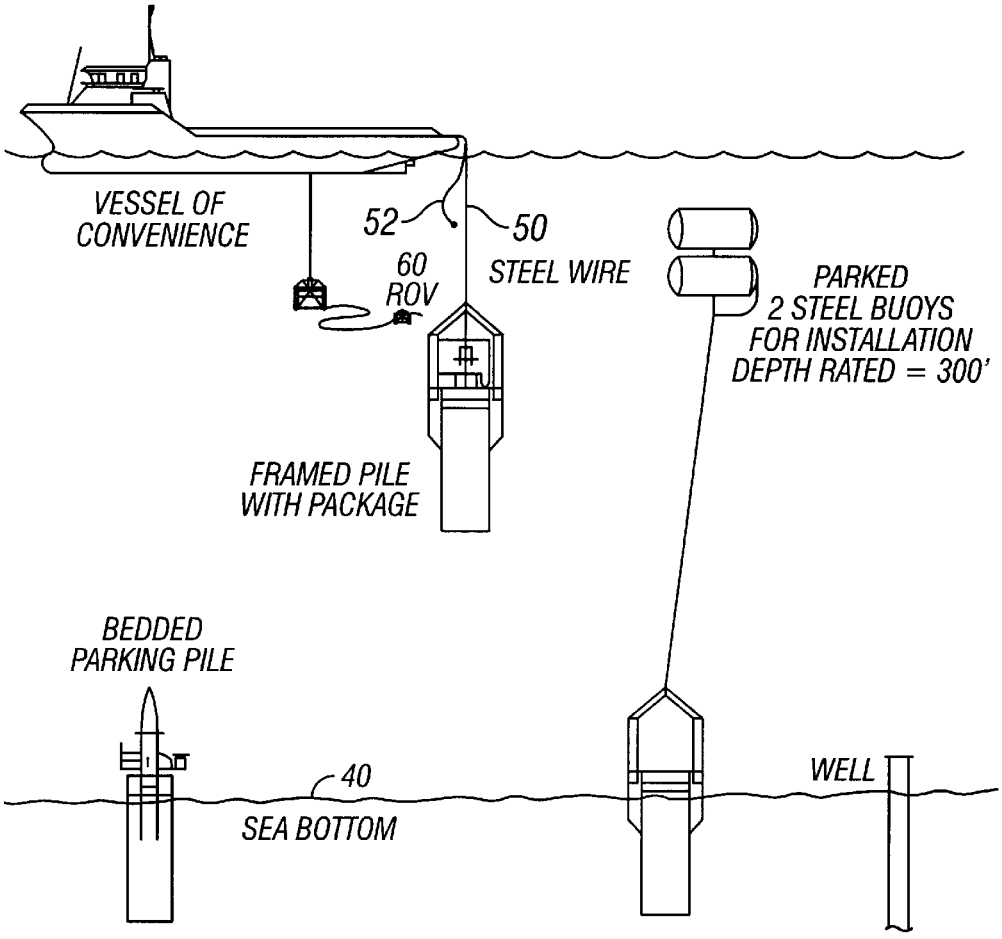
Figure 14:
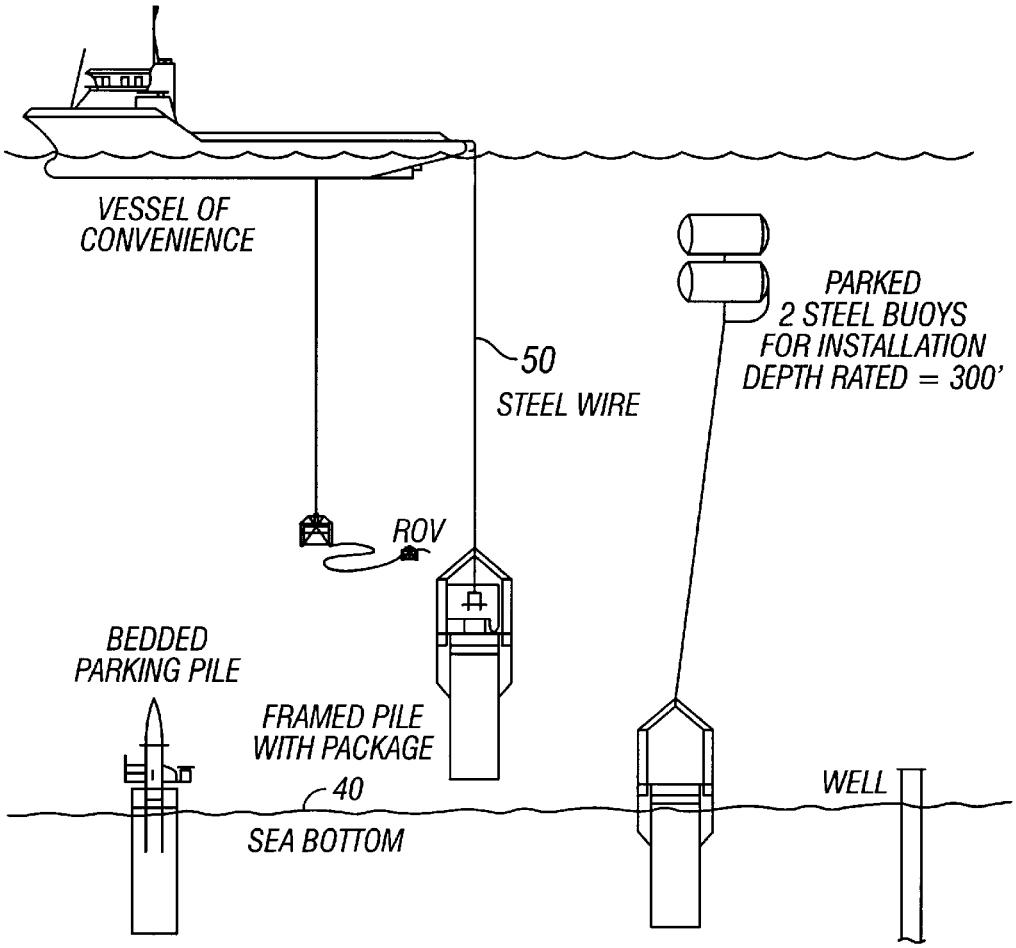
Figure 15:
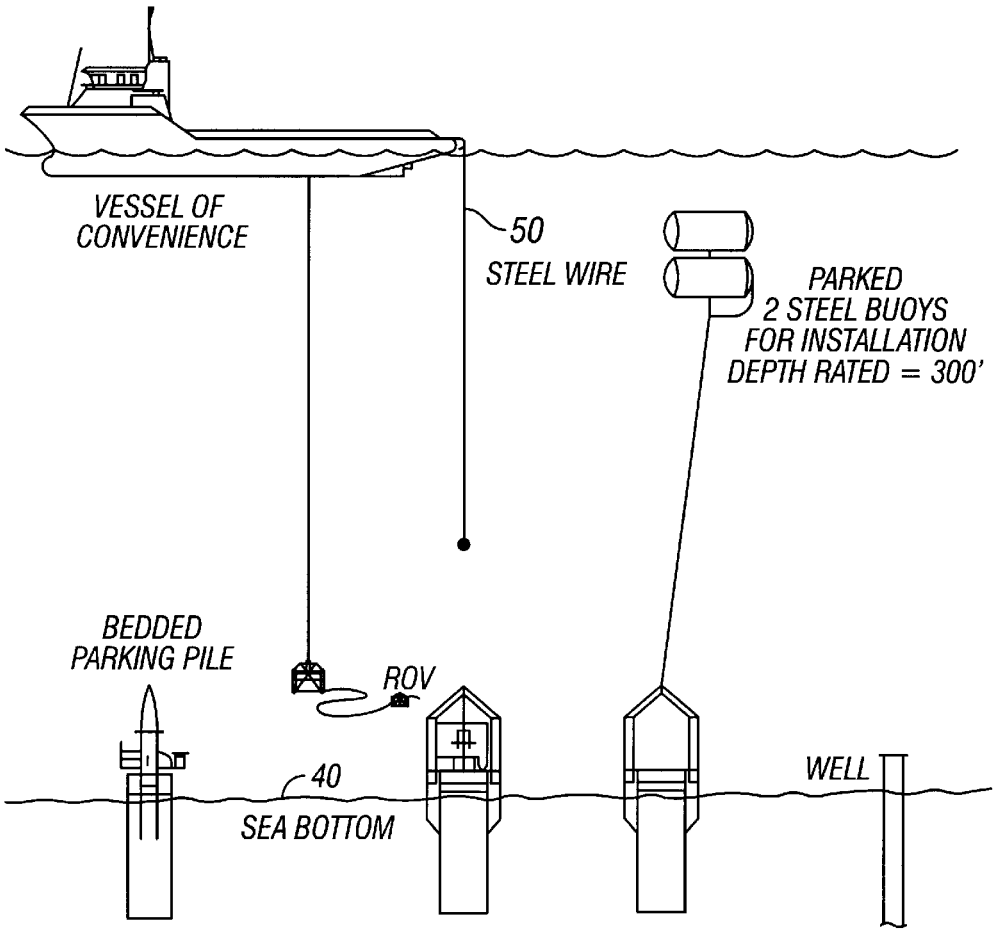

FIG. 12 shows the parking pile 10, metal frame 200, and subsea tree 80 being lowered by the hoisting line 50 and a launching line 52. As seen in FIG. 13, once the framed pile with package is submerged, a remotely operated vehicle 60 is used to release the launching line 52 (for example, by an ROV-activated release mechanism). The pile 10 is then lowered to the sea bottom 40 with only the hoisting line 50. As the framed pile with package reaches the sea bottom 40, the ROV 60 releases the hoisting line 50 so that the framed pile with package embeds itself into the sea bottom 40. The ROV 60 can provide visual feedback to the operators and final guidance of the framed pile with package. Of course, the framed pile may also be parked on the sea bottom as described above without carrying any package or subsea equipment in its descent to the sea bottom.

Turning now to FIGS. 16–21, there are shown the basic steps in moving a previously parked piece of subsea equipment 80, brought to the sea bottom 40 within a frame 200 on the pile 10, to a desired operating location, such as a wellhead 180. In this embodiment of the wet parking system, before moving the parked subsea equipment, the frame 200 must be unhinged or otherwise removed to gain access to the protected subsea equipment.

Figure 16:
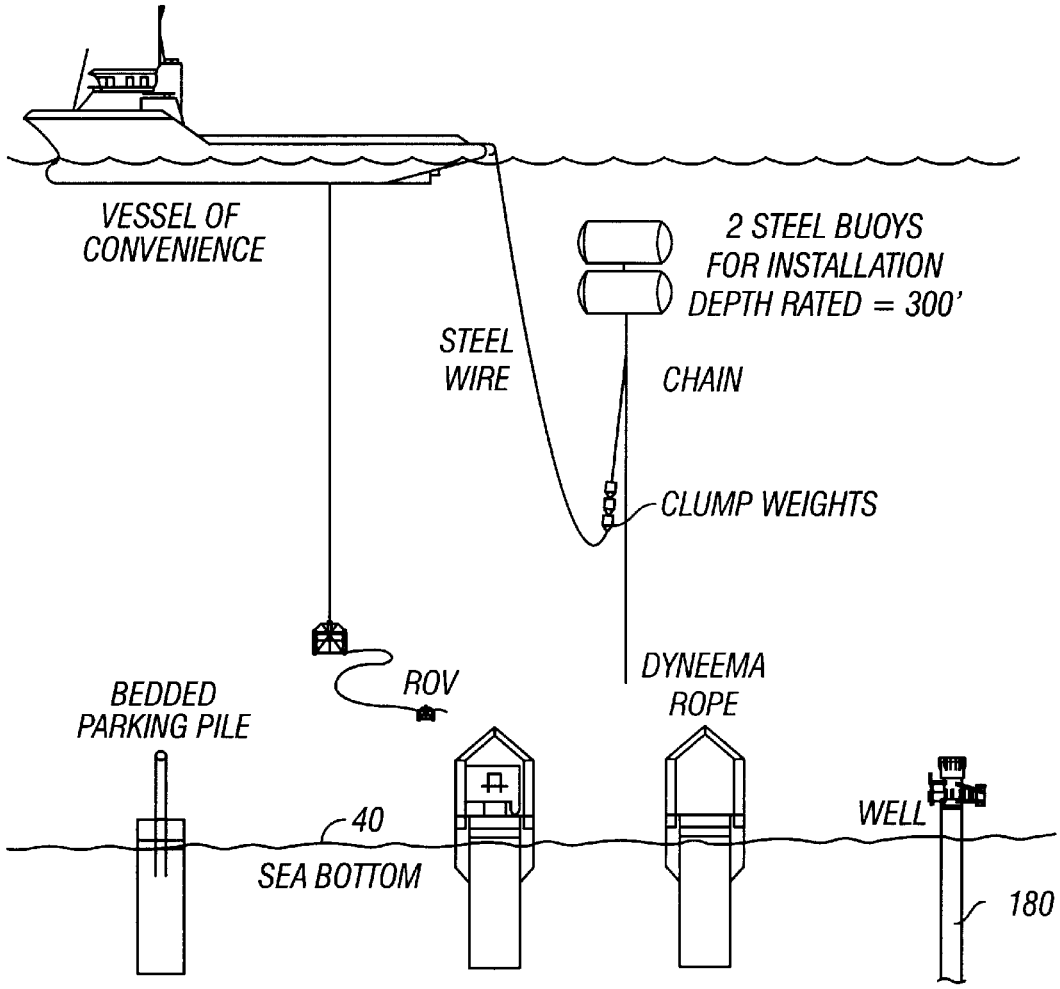
FIGS. 16–21 are side elevation views of a parked subsea well tree or any other payload being removed from a framed parking pile and then moved to a distant operating location.
Figure 17:
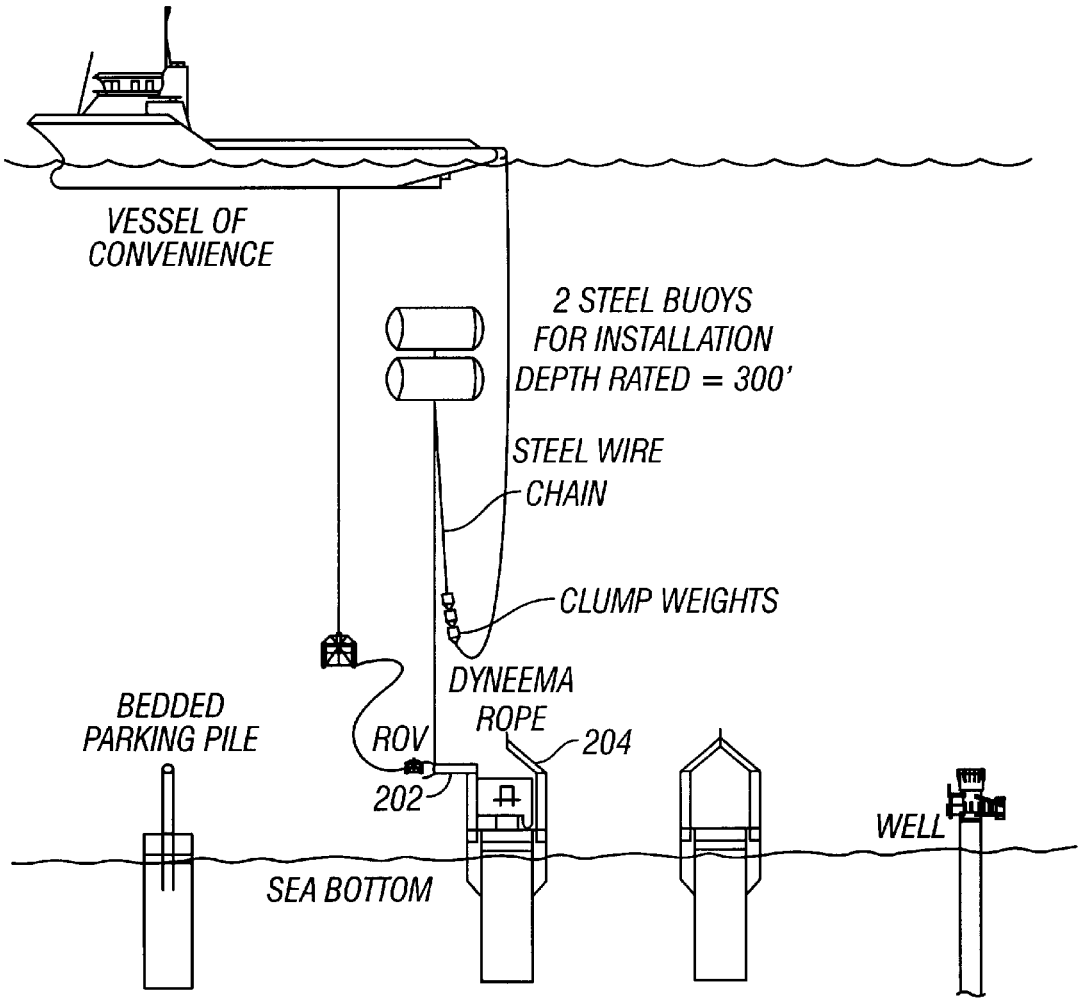
Figure 18:
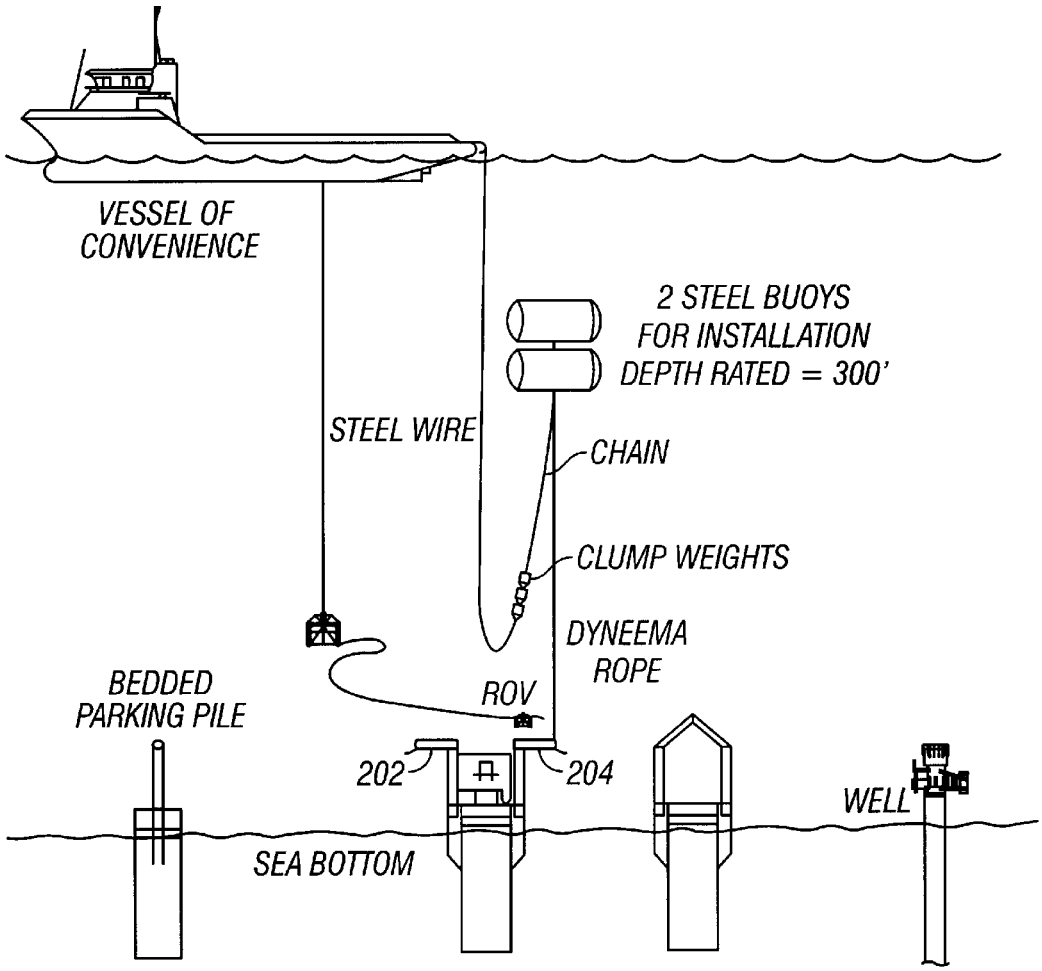

FIG. 16 shows a tree 80 parked within a frame 200 on a bedded parking pile 10. In FIG. 17 an ROV 60 operates a tool that is attached to the pendant line 170 to remove or open one of the hinged doors 202 of the pile frame 200. In FIG. 18, the other door 204 is similarly opened. With doors 202 and 204 hinged open, access can be made to the tree 80.

Figure 19:
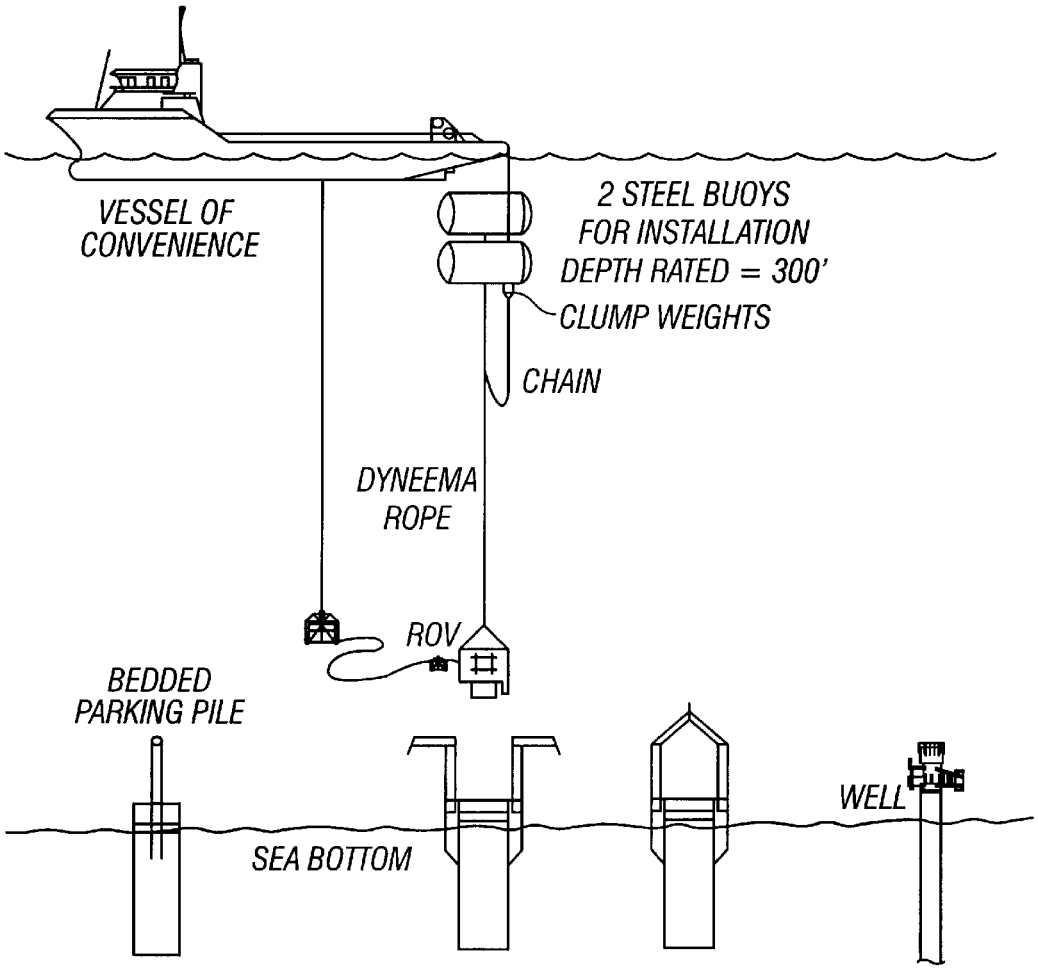

In FIG. 19, one or more steel buoys 160 are tethered to the parked tree 80 with a pendant line 170, such as dyneema rope. When it is desired to move the subsea tree 80 to a tubing hanger spool 190 mounted to the wellhead 180, the steel wire 140 is raised or winded up toward the vessel 20. As the clump weights 150 are carried by steel wire 140 and no longer by buoys 160, the buoys begin to float toward the surface 30 of the water, thus lifting the subsea tree 80 from the parking pile 10.

Figure 20:
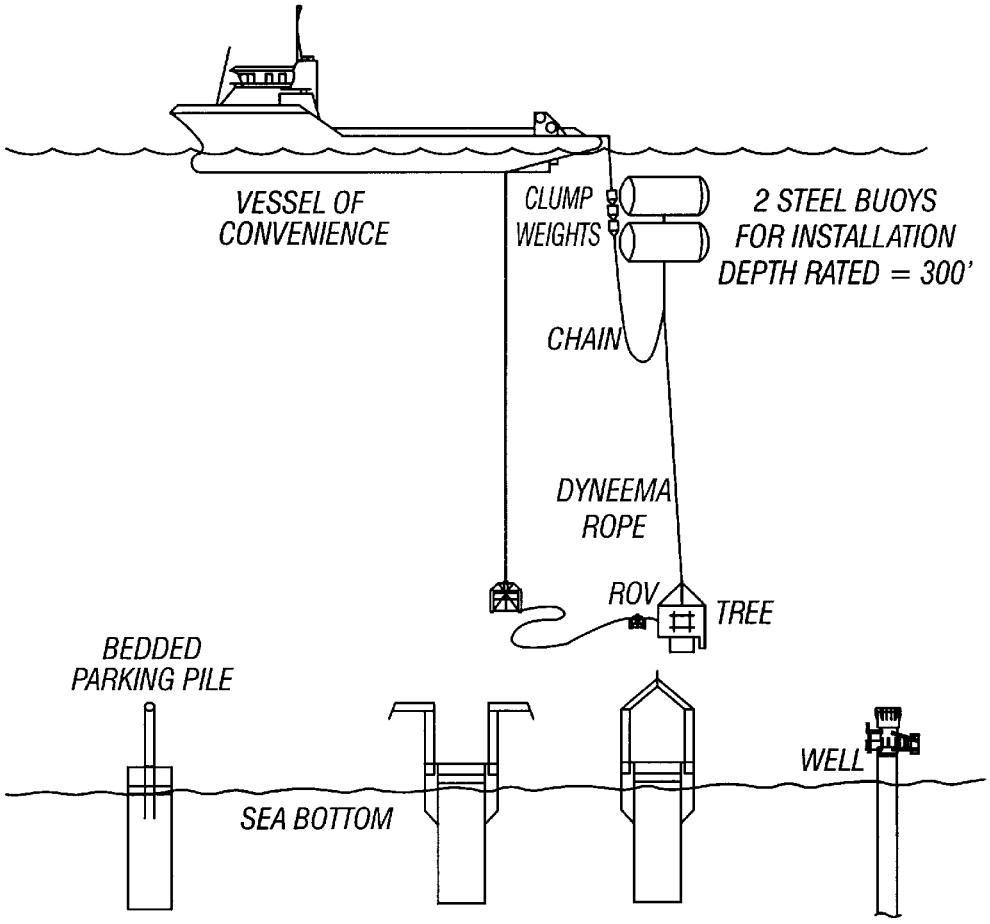

As seen in FIG. 20, with the assistance of an ROV 60, the subsea tree 80 can be transported to the location of interest (such as a wellhead 180) and then be moved close and steady above the tubing hanger spool 190. If the distance between the pile where the payload is removed and the operating location of interest is far, the vessel itself may be used to transport the payload to the location of interest. While only one ROV is shown in the drawings for transporting the payloads, additional ROVs can be used in the present invention to transport the payloads and to monitor other subsea activities, such as the interaction of the chain 130 and the pendant line 170 with the buoys 160.

Figure 21:
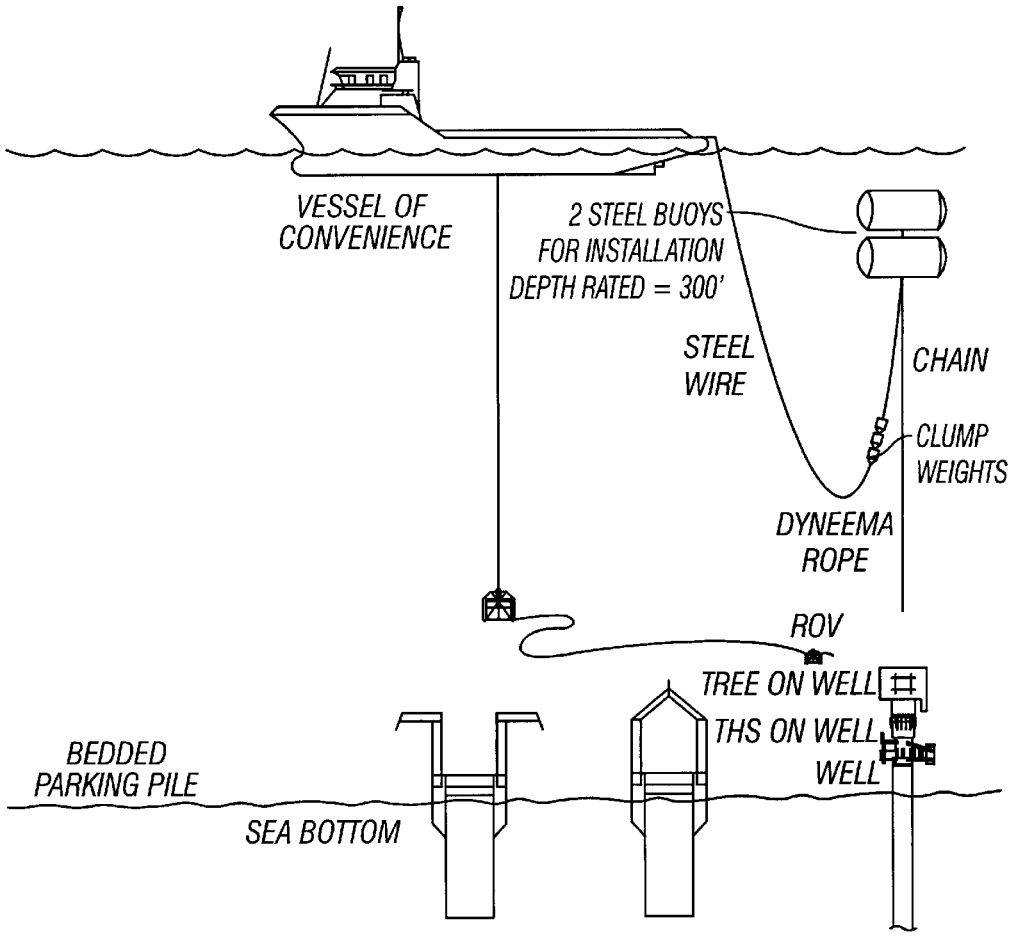

In FIG. 21, the deployment line or steel wire 140 is lowered or payed out causing the buoys 160 to fall to equalize the load. With the assistance of the ROV, the subsea tree 80 is then engaged or mounted on the tubing hanger spool 190. The ROV 60 can also be used to release the pendant line or dyneema rope 170 from the tree 80.

In yet another embodiment of the wet parking system of the present invention, shown in FIGS. 22–27, the subsea equipment is again integrally mounted to the parking pile, but without the protective metal frame. In this embodiment, a launching device or frame 210 is used to horizontally launch the combined parking pile 10 and tree 80. The launching frame 210 physically distances the tree 80 from the vessel 20, such that when the pile 10 and tree 80 are transported on and launched from the vessel 20, the tree 80 does not touch, crash into, or otherwise bang on the vessel 20.

Figure 22:
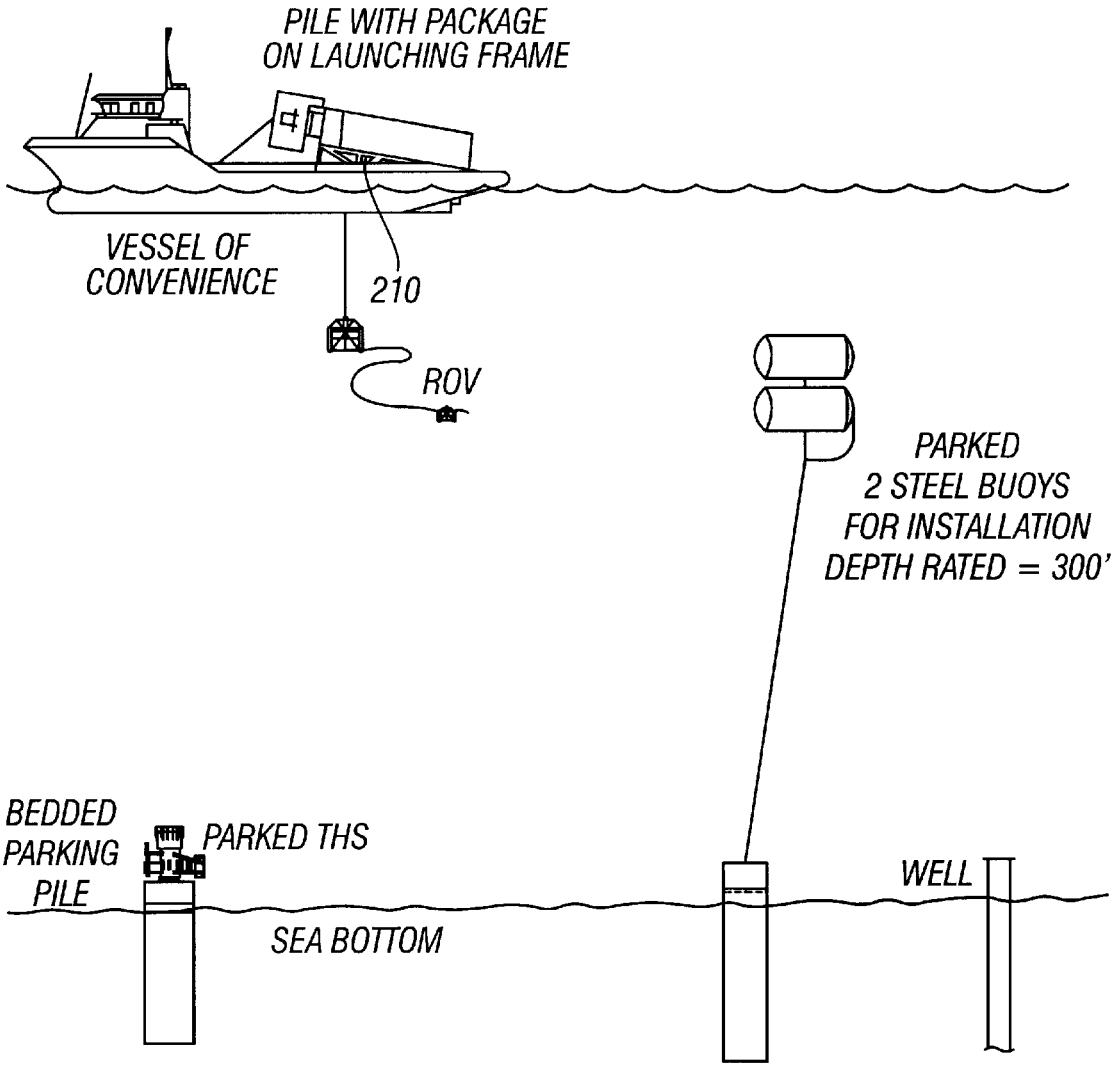
FIGS. 22–27 are side elevation views of subsea equipment integrally mounted to a parking pile being launched from a transport vehicle with a launching frame, lowered to the sea bottom without the launching frame, and then released and bedded together as a unit in the sea bottom.
Figure 23:
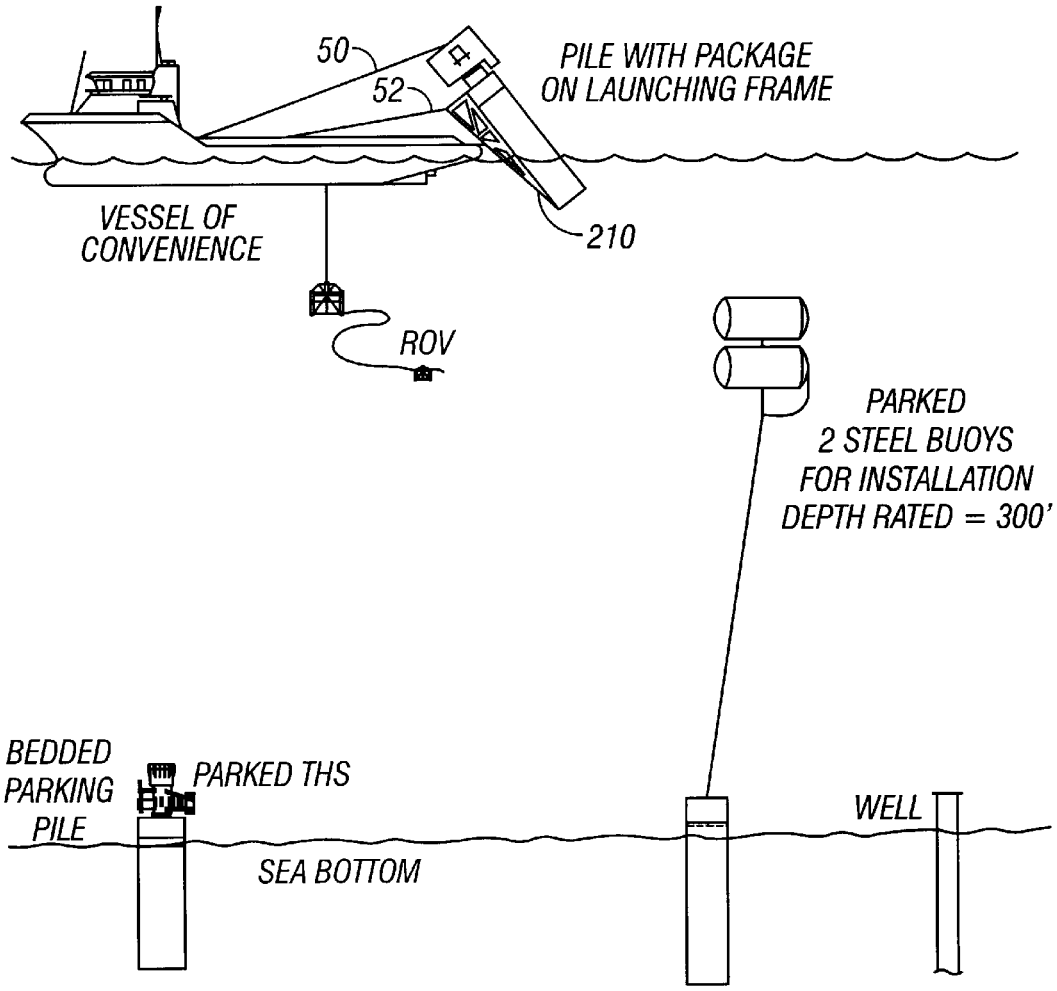
Figure 24:
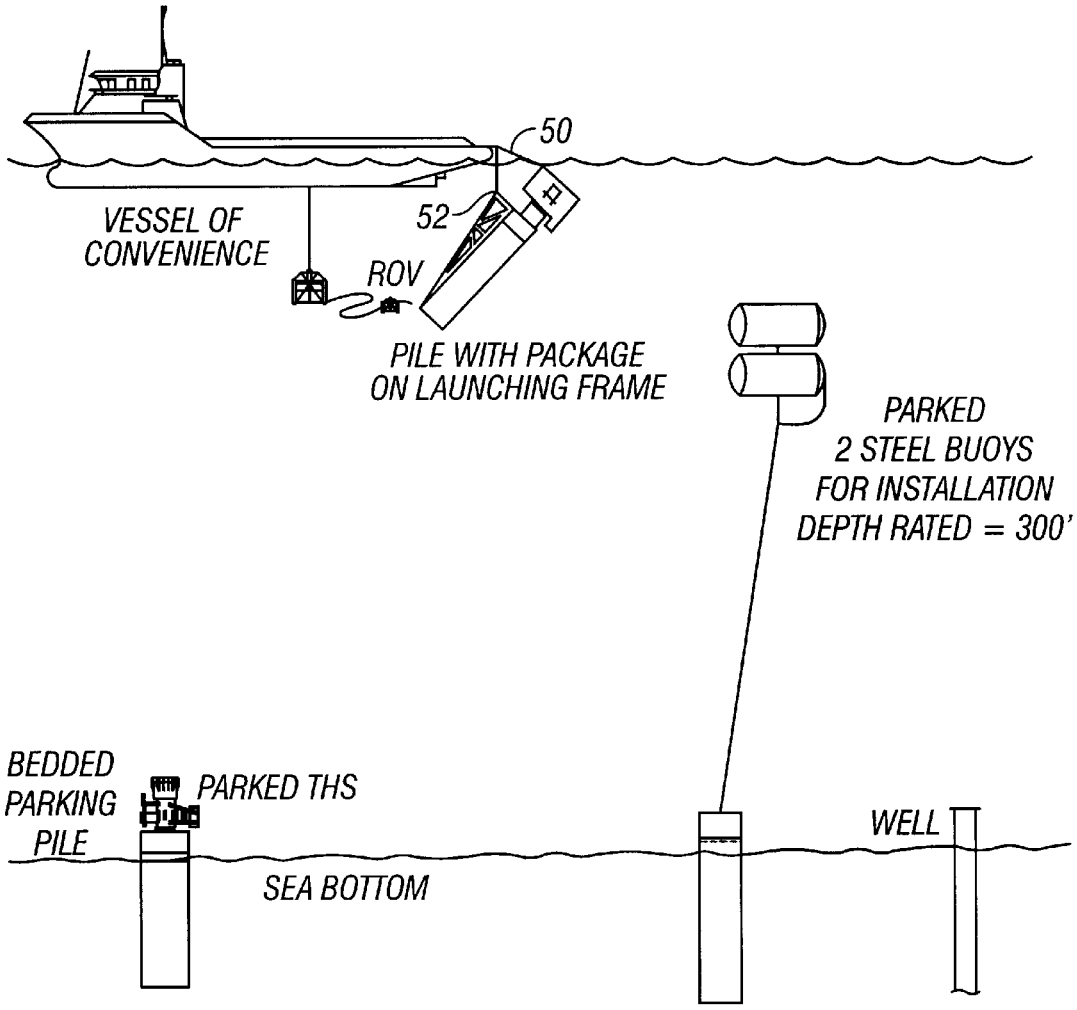
Figure 25:
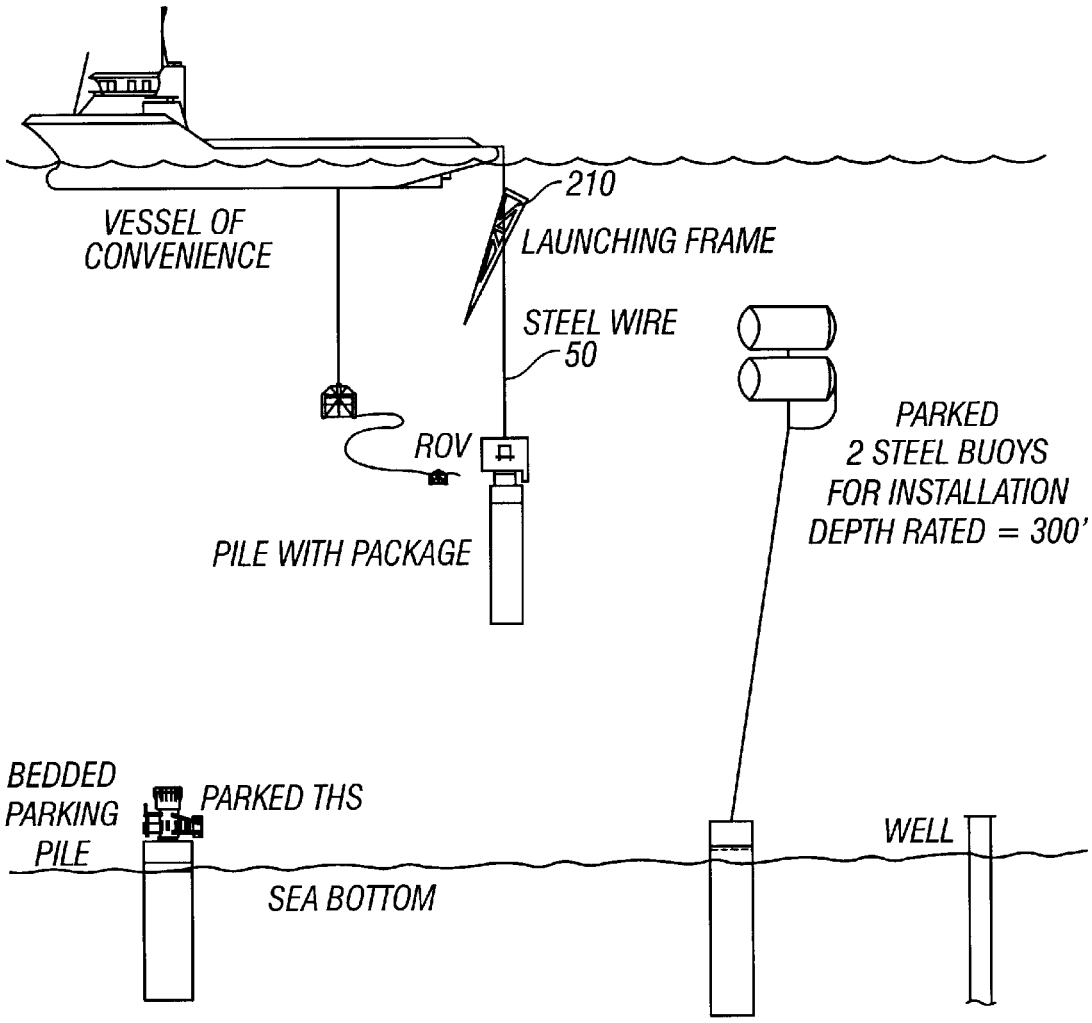
Figure 26:
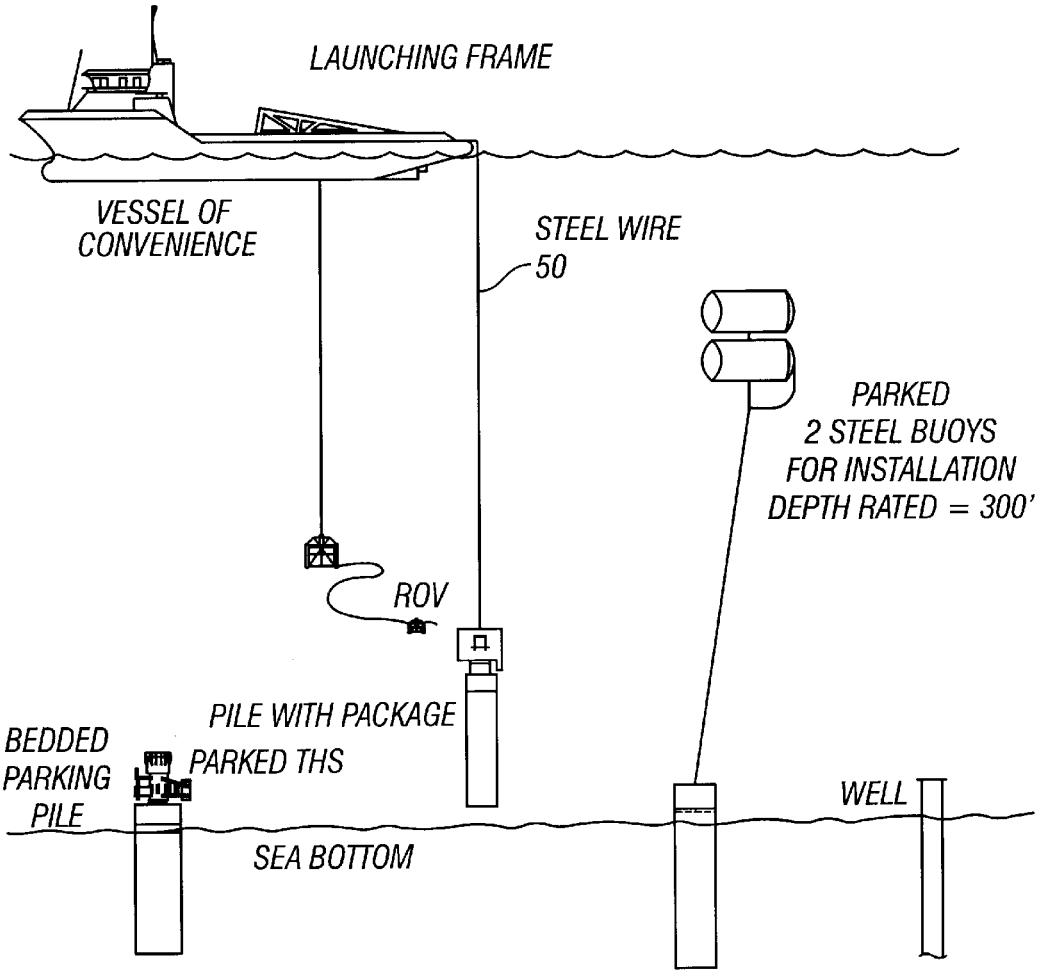
Figure 27:
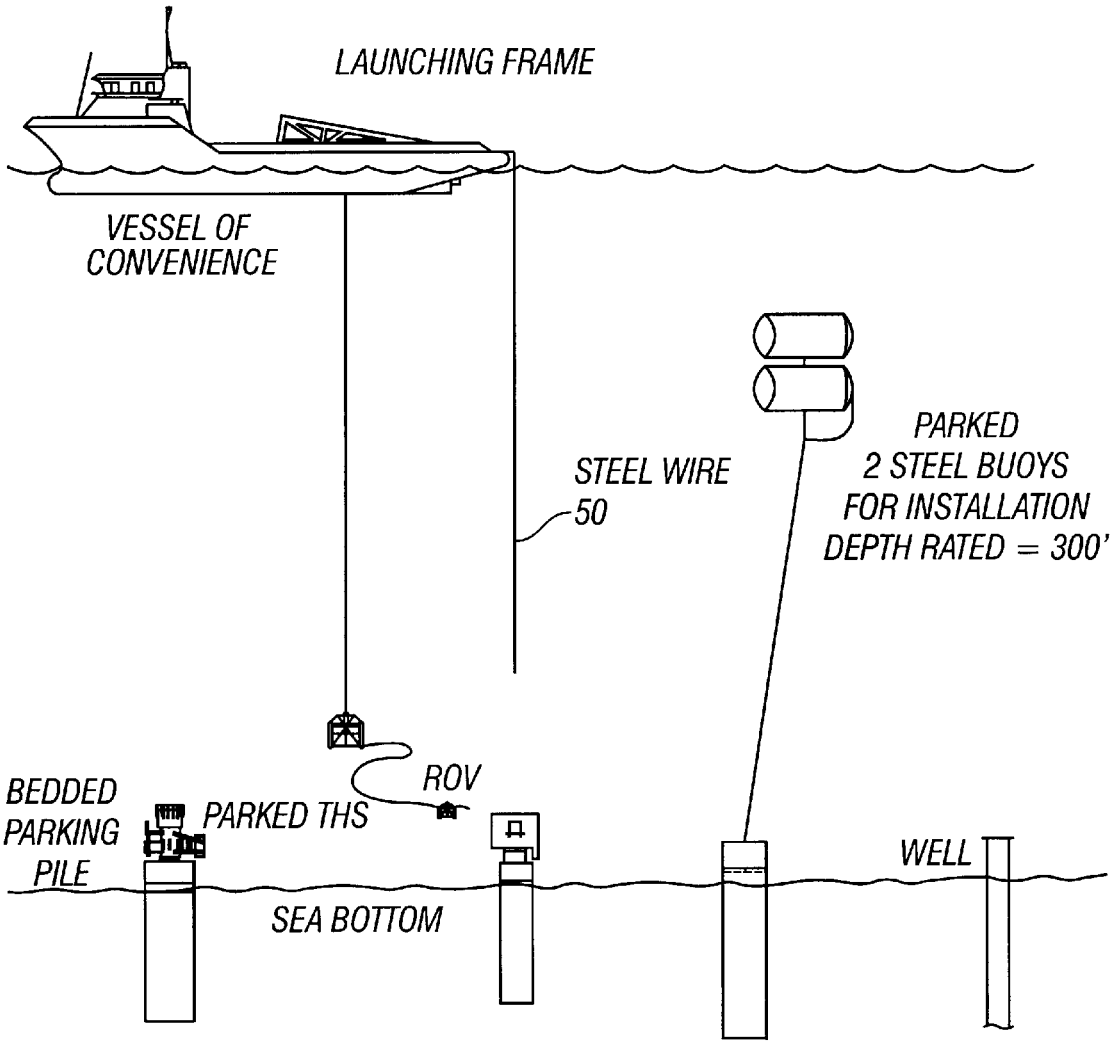

FIG. 22 shows the parking pile 10 and subsea package 80 supported by the launching frame 210 on the deck of the vessel 20. The launching frame is a truss like steel structure forming a wedge shaped frame. Other lightweight materials are also possible such as aluminum or composites if necessary and/or cost effective. Whatever configuration, the launching frame should support the load, take bending moments, and keep the equipment a safe distance from the vessel. FIGS. 23 and 24 show the launching of all three apparatuses, the parking pile 10, subsea package 80, and launching frame 210, from the stern of the transport vessel 20. The launching is facilitated by a hoisting line 50 attached to the top of the subsea tree 80 and a launching line 52 attached to the launching frame 210. In FIG. 25, the launching frame 210 is separated from the parking pile 10 and subsea package 80. In FIG. 26, the launching frame 210 is retrieved and returned to the deck of the transport vessel 20. The parking pile 10 and its mounted subsea equipment 80 are lowered to the sea bottom 40 with the hoisting line 50. If desired, mass traps may be added to the hoisting line and lowering line axial properties can be engineered to achieve the desired strength and dynamic response properties. In FIG. 27, the parking pile with the subsea equipment package is released and bedded in the sea bottom 40. Instead of being a separate and reusable device, in other embodiments, the launching frame could be integrally formed with or connected to the suction pile and bedded.

FIG. 28 provides a comparison of heave RAOs for different support vessels: head and quartering seas. The y-axis represents RAO in units of ft/ft and the x-axis is the period in units of seconds. The support vessels are as follows: large closed diamond (♦)-Marianas Head Seas at CG; closed triangle (▲)-Marianas Quartering Seas at CG; closed circle (●)-Sea Sorceress Quartering Seas at CG; open triangle (Δ)-Jim Thomson Head Seas at CG; small closed diamond (♦)-Perseus Head Seas forward of moonpool: closed square (■)-Chouest Ross Head Seas at CG; (*)-Chouest Ross Head Seas at Lift Point; and (X)-Marianas Head Seas aft 150 ft.

FIG. 29 provides a comparison of heave RAOs for different supuort vessels: beam seas. The y-axis represents RAO in units of ft/ft and the x-axis is the period in units of seconds. The support vessels are as follows: (●)-Marianas at CG; (▲)-Sea Sorceress at CG; and closed diamond (♦)-Chouest Ross at Lift Point.

While the above description focuses on the use of a wet pile parking system, alternative systems may be designed, such as a retrievable deployment base on which subsea equipment may be landed or parked. The base can be dimensioned to resist substantial penetration into the sea floor, but sufficient to act as a shock absorber during the set down of the equipment on the sea floor.

The above-described invention will be more specifically exemplified by the following examples that are introduced to illustrate further the novelty and utility of the present invention but not with the intention of unduly limiting the same.

EXAMPLES

A study was conducted to assess various options for the deployment of subsea equipment (tubing hanger spools and subsea well trees) in deep water Gulf of Mexico for the Nakika (7600 feet water depth) field development.

Description of the Packages Being Deployed

Tubing Hanger Spools

The standard tubing head (see A below) incorporates upward facing or funnel up tops and downward facing or funnel down bottom interfaces. Its weight in air is approximately 30 short tons. The estimated properties are:

| Package data | |
|---|---|
| Weight in air (lbsf) | = 60,000 (30 short stons) |
| Mass of the package in water (lbs) | = 60,000 |
| Buoyancy of the package (lbs) | = 10,000 |
| Added-mass (lbs) | = 20,000 |

-continued

| Package data | |
|---|---|
| Drag coefficient (Cd) | = 1.5 |
| Area of package exposed to drag ($ft^2$) | = 200 |

The tubing head is lowered in preparation for landing. An ROV docks into the cones on the ROV panel and provides telemetry to the surface to aid in achieving the desired heading for the tubing head. Next, the tubing head assembly is landed on the housing and locked in place. The tubing head spool provides a transition between the wellhead housing and the Xmas tree, as well as a transition from the subsequently installed tree production flow-loop and well jumper via a U-loop assembly.

Subsea Tree

The subsea tree is landed on the tubing head assembly as shown in Figure B below. It weighs 40 short tons in air. The estimated properties are:

| Package data | |
|---|---|
| Weight in air (lbsf) | = 80,000 (40 short stons) |
| Mass of the package in water (lbs) | = 80,000 |
| Buoyancy of the package (lbs) | = 16,000 |
| Added-mass (lbs) | = 30,000 |
| Drag coefficient (Cd) | = 1.5 |
| Area of package exposed to drag ($ft^2$) | = 200.0000 |

Description of Ropes Being Used

A range of ropes have been investigated, including spiral stranded steel wire, Dyneema rope, and polyester rope as follows:

TABLE 1

Steel Rope Properties for 7600 ft water depth deployment of 40 ton load

| | Units | Rope Sizes (nominal diameter) | | | | | | |
|---|---|---|---|---|---|---|---|---|
| Wire (Spiral 8 Strand - ISO Grade 200) | in | 2¼ | 2½ | 2¾ | 3 | 3¼ | 3½ | 3¾ |
| | mm | 57.15 | 63.50 | 69.85 | 76.20 | 82.55 | 88.90 | 95.25 |
| E (spiral strand steel wire) | psi | 1.233E + 07 | 1.233E + 07 | 1.233E + 07 | 1.233E + 07 | 1.233E + 07 | 1.233E + 07 | 1.233E + 07 |
| | kgf/cm2 | 8.67E + 05 | 8.67E + 05 | 8.67E + 05 | 8.67E + 05 | 8.67E + 05 | 8.67E + 05 | 8.67E + 05 |
| | MPa | 8.50E + 04 | 8.50E + 04 | 8.50E + 04 | 8.50E + 04 | 8.50E + 04 | 8.50E + 04 | 8.50E + 04 |
| | kN/mm2 | 85 | 85 | 85 | 85 | 85 | 85 | 85 |
| Mean Breaking Load (MBL) | kip | 520 | 914 | 1095 | 1425 | 1580 | 1812 | 2085 |
| | kN | 2311 | 2854 | 3453 | 4109 | 4822 | 5593 | 6420 |
| | ston | 214 | 264 | 319 | 380 | 446 | 517 | 594 |
| Allowable Load (MBL/3) | ston | 71 | 88 | 106 | 127 | 149 | 172 | 198 |
| A | in2 | 2.33 | 2.88 | 3.48 | 4.14 | 4.86 | 5.64 | 6.47 |
| EA | lbs | 2.872E + 07 | 3.546E + 07 | 4.291E + 07 | 5.107E + 07 | 5.993E + 07 | 6.951E + 07 | 7.979E + 07 |
| | kN | 1.278E + 05 | 1.577E + 05 | 1.909E + 05 | 2.272E + 05 | 2.666E + 05 | 3.092E + 05 | 3.549E + 05 |
| Weight | lbs/ft | 11.84 | 14.62 | 17.69 | 21.05 | 24.71 | 28.66 | 32.90 |
| | kgf/m | 17.62 | 21.76 | 26.33 | 31.33 | 36.77 | 42.65 | 48.96 |
| Stiffness (EA/L) | lbs/ft | 3780 | 4666 | 5646 | 6719 | 7886 | 9146 | 10499 |
| Total Wire Weight | lbs | 90005 | 111117 | 134451 | 160008 | 187787 | 217789 | 250013 |
| | mton | 40.83 | 50.40 | 60.99 | 72.58 | 85.18 | 98.79 | 113.40 |
| Natural Period, Tn (code) | sec | 6.74 | 6.21 | 5.80 | 5.46 | 5.18 | 4.95 | 4.75 |
| Mean Load on Rope | ston | 62.20 | 69.29 | 77.12 | 85.69 | 95.01 | 105.08 | 115.90 |

TABLE 2

Dyneema Rope Properties for 7600 ft water depth deployment of 40 ton load

| | Units | Synthetic Dyneema Fiber Rope Sizes (nominal diameter) | | | | |
|---|---|---|---|---|---|---|
| Dyneema | in | 2⅓ | 2½ | 2⅔ | 2⅚ | 3⅐ |
| | mm | 60 | 64 | 68 | 72 | 80 |
| E (deduced from EA) | psi | 4.02E + 06 | 4.57E + 06 | 4.36E + 06 | 4.36E + 06 | 4.37E + 06 |
| | kgf/cm2 | 2.83E + 05 | 3.22E + 05 | 3.07E + 05 | 3.06E + 05 | 3.07E + 05 |
| | MPa | 2.77E + 04 | 3.15E + 04 | 3.01E + 04 | 3.01E + 04 | 3.01E + 04 |
| | kN/mm2 | 27.75 | 31.53 | 30.09 | 30.05 | 30.10 |
| Breaking Load (Superline) | kip | 370 | 465 | 516 | 578 | 714 |
| | kN | 1648 | 2069 | 2295 | 2569 | 3177 |
| | ston | 168 | 211 | 234 | 262 | 324 |
| Allowable Load (MBL/3) | ston | 56 | 70.33 | 78 | 87 | 108 |
| A (70% circle approx.) | in2 | 3.07 | 3.39 | 3.94 | 4.42 | 5.45 |
| EA (3% elongation at 100% breaking load) | lbs | 1.23E + 07 | 1.55E + 07 | 1.72E + 07 | 1.93E + 07 | 2.38E + 07 |
| | kN | 5.49E + 04 | 6.90E + 04 | 7.65E + 04 | 8.56E + 04 | 1.06E + 05 |
| Weight | lbs/ft | 1.384 | 1.572 | 1.774 | 1.989 | 2.453 |
| | kgf/m | 2.06 | 2.34 | 2.64 | 2.96 | 3.65 |
| Stiffness (EA/L) | lbs/ft | 1624 | 2040 | 2263 | 2533 | 3133 |
| Total Wire Weight | lbs | 10520 | 11950 | 13482 | 15117 | 18640 |

TABLE 2-continued

| Dyneema Rope Properties for 7600 ft water depth deployment of 40 ton load | | | | | | |
|---|---|---|---|---|---|---|
| | Units | Synthetic Dyneema Fiber Rope Sizes (nominal diameter) | | | | |
| | mton | 4.77 | 5.42 | 6.12 | 6.86 | 8.46 |
| Natural Period, Tn (code) | sec | 9.26 | 8.28 | 7.88 | 7.46 | 6.74 |
| Mean Load on Rope | ston | 21.35 | 20.38 | 18.31 | 16.66 | 13.05 |

TABLE 3

| Polyester Rope Properties for 7600 ft water depth deployment of 40 ton load | | | | | | |
|---|---|---|---|---|---|---|
| | Units | Synthetic Polyester Fiber Rope Sizes (nominal diameter) | | | | |
| Polyester | in | 4½ | 4⅞ | 5 | 5¾ | 6⅜ |
| | mm | 113.2 | 121.3 | 129.4 | 145.5 | 161.7 |
| E (deduced from EA) | psi | 6.92E + 05 | 6.92E + 05 | 6.51E + 05 | 6.20E + 05 | 5.95E + 05 |
| | kgf/cm2 | 4.87E + 04 | 4.86E + 04 | 4.58E + 04 | 4.36E + 04 | 4.18E + 04 |
| | MPa | 4.77E + 03 | 4.77E + 03 | 4.49E + 03 | 4.27E + 03 | 4.10E + 03 |
| | kN/mm2 | 4.77 | 4.77 | 4.49 | 4.27 | 4.10 |
| Breaking load | kip | 364 | 419 | 474 | 595 | 728 |
| | kN | 1619 | 1864 | 2109 | 2649 | 3237 |
| | ston | 165 | 190 | 215 | 270 | 330 |
| Allowable Load (MBL/3) | ston | 55 | 63 | 72 | 90 | 110 |
| A (70% circle approx.) | in2 | 10.92 | 12.18 | 14.27 | 18.04 | 22.28 |
| EA (as a function of mean load) | lbs | 7.56E + 06 | 8.42E + 06 | 9.29E + 06 | 1.12E + 07 | 1.33E + 07 |
| | kN | 3.36E + 04 | 3.75E + 04 | 4.13E + 04 | 4.98E + 04 | 5.90E + 04 |
| Weight | lbs/ft | 6.720 | 7.728 | 8.803 | 11.156 | 13.708 |
| | N/m | 98.1 | 112.815 | 128.511 | 162.864 | 200.124 |
| Stiffness (EA/L) | lbs/ft | 995 | 1108 | 1222 | 1472 | 1745 |
| Total Wire Weight | lbs | 51070 | 58730 | 66901 | 84785 | 104182 |
| | ton | 23.16 | 26.64 | 30.35 | 38.46 | 47.26 |
| Natural Period, Tn (code) | sec | 12.52 | | | | |
| Mean Load on Rope | ton | 0.29 | −2.57 | −9.37 | −20.21 | −32.72 |

Description of Vessels

TABLE C

| Transocean Marianas main characteristics | |
|---|---|
| Rig Type | High-Specification Semisubmersible |
| Design | Earl & Wright Sedco 700 Series |
| Operating Conditions | Hs = 25 ft; Wind: 50 knots; Current: 2.5 knots |
| Length | 264 ft (80 m) |
| Breadth | 197 ft (60 m) |
| Depth | 122 ft (37 m) |
| Operating Draft | 81 ft (25 m) |
| Variable Deck Load (VDL)-Operating | 4107 st (3727 mt) |

TABLE D

| Sea Sorceress main characteristics | |
|---|---|
| Vessel Type | ABS DP II Manned Barge (General Support and Pipelay Vessel) |
| Design | Cal Dive Offshore Ltd. |
| Features | Large Crane and moonpool (14.9 m × 6.1 m) |
| Length | 374 ft (114 m) |
| Breadth | 105 ft (32 m) |
| Depth | 25 ft (7.6 m) |
| Maximum Draft | 18 ft (5.6 m) |
| Deck Space | 1647 m2 |

TABLE E

| M/V Ross Chouest main characteristics | |
|---|---|
| Vessel Type | General Diver Support Vessel on contract to Shell |
| Design | Edison Chouest Offshore Inc. |
| Chain Lockers | 12,000 ft of 3" chain (+2 storage reels with 2 drums and handling winches, 6500' × 3¾" wire each) |
| Length | 263 ft (80 m) |
| Breadth | 54 ft (16.5 m) |
| Depth | 24 ft (7.3 m) |
| Operating Draft | 16 ft (5 m) |
| Variable Deck Load (VDL)-Operating | 1200 long stons |

Results and Conclusions

| Marianas Semi-submersible | | | | |
|---|---|---|---|---|
| Steel Wire Diameter (in) | Maximum vertical Motion (single amp) | Percentage of time below threshold | Max sea-state | Max line tension |
| THS LANDING - MARIANAS - FEBRUARY - HEAD SEAS | | | | |
| 2¼ | 10 in | 65% | 5 ft | 67 stons |
| MBL = 236 t | 24 in | 87% | 8 ft | 68 stons |
| | 48 in | 97% | 11 ft | 69 stons |
| | 72 in | 99% | 14 ft | 70 stons |
| 2¾ | 10 in | 67% | 6 ft | 87 stons |
| MBL = 352 t | 24 in | 89% | 9 ft | 88 stons |
| | 48 in | 98% | 13 ft | 89 stons |
| | 72 in | 100% | 17 ft | 90 stons |

-continued

| Marianas Semi-submersible | | | | |
|---|---|---|---|---|
| 3¼ | 10 in | 73% | 7 ft | 112 stons |
| MBL = 492 t | 24 in | 92% | 10 ft | 114 stons |
| | 48 in | 98% | 13 ft | 114 stons |
| | 72 in | 100% | 17 ft | 116 stons |
| 3½ | 10 in | 73% | 7 ft | 126 stons |
| MBL = 570 t | 24 in | 92% | 10 ft | 127 stons |
| | 48 in | 98% | 13 ft | 128 stons |
| | 72 in | 100% | 18 ft | 130 stons |
| 3¾ | 10 in | 73% | 7 ft | 141 stons |
| MBL = 655 t | 24 in | 92% | 10 ft | 142 stons |
| | 48 in | 99% | 13 ft | 144 stons |
| | 72 in | 100% | 18 ft | 145 stons |
| THS LANDING - MARIANAS - APRIL - HEAD SEAS | | | | |
| 2¼ | 10 in | 73% | 5 ft | 67 stons |
| MBL = 236 t | 24 in | 89% | 5 ft | 67 stons |
| | 48 in | 98% | 11 ft | 69 stons |
| | 72 in | 99% | 14 ft | 70 stons |
| 2¾ | 10 in | 75% | 6 ft | 88 stons |
| MBL = 352 t | 24 in | 92% | 9 ft | 88 stons |
| | 48 in | 98% | 12 ft | 90 stons |
| | 72 in | 100% | 16 ft | 91 stons |
| 3¼ | 10 in | 81% | 7 ft | 112 stons |
| MBL = 492 t | 24 in | 94% | 10 ft | 113 stons |
| | 48 in | 99% | 12 ft | 114 stons |
| | 72 in | 100% | 17 ft | 116 stons |
| 3½ | 10 in | 81% | 7 ft | 126 stons |
| MBL = 570 t | 24 in | 94% | 10 ft | 127 stons |
| | 48 in | 99% | 12 ft | 128 stons |
| | 72 in | 100% | 17 ft | 129 stons |
| 3¾ | 10 in | 81% | 7 ft | 141 stons |
| MBL = 655 t | 24 in | 94% | 10 ft | 142 stons |
| | 48 in | 99% | 12 ft | 144 stons |
| | 72 in | 100% | 17 ft | 144 stons |
| THS LANDING - MARIANAS - MAY - HEAD SEAS | | | | |
| 2¼ | 10 in | 89% | 5 ft | 67 stons |
| MBL = 236 t | 24 in | 98% | 8 ft | 68 stons |
| | 48 in | 100% | 12 ft | 69 stons |
| 2¾ | 10 in | 90% | 6 ft | 88 stons |
| MBL = 352 t | 24 in | 98% | 9 ft | 88 stons |
| | 48 in | 100% | 13 ft | 90 stons |
| 3¼ | 10 in | 94% | 7 ft | 112 stons |
| MBL = 492 t | 24 in | 99% | 10 ft | 113 stons |
| | 48 in | 100% | 13 ft | 114 stons |
| 3½ | 10 in | 94% | 7 ft | 126 stons |
| MBL = 570 t | 24 in | 99% | 10 ft | 127 stons |
| | 48 in | 100% | 13 ft | 128 stons |
| 3¾ | 10 in | 94% | 7 ft | 141 stons |
| MBL = 655 t | 24 in | 99% | 10 ft | 142 stons |
| | 48 in | 100% | 13 ft | 143 stons |
| TREE LANDING - MARIANAS - FEBRUARY - HEAD SEAS | | | | |
| 2¼ | 10 in | 36% | 3 ft | 74 stons |
| MBL = 236 t | 24 in | 67% | 6 ft | 76 stons |
| | 48 in | 94% | 11 ft | 78 stons |
| | 72 in | 98% | 13 ft | 79 stons |
| 2¾ | 10 in | 65% | 5 ft | 94 stons |
| MBL = 352 t | 24 in | 87% | 8 ft | 96 stons |
| | 48 in | 97% | 11 ft | 98 stons |
| | 72 in | 99% | 15 ft | 99 stons |
| 3¼ | 10 in | 67% | 6 ft | 120 stons |
| MBL = 492 t | 24 in | 89% | 9 ft | 120 stons |
| | 48 in | 98% | 13 ft | 122 stons |
| | 72 in | 99% | 16 ft | 124 stons |
| 3½ | 10 in | 67% | 6 ft | 134 stons |
| MBL = 570 t | 24 in | 89% | 9 ft | 134 stons |
| | 48 in | 98% | 13 ft | 136 stons |
| | 72 in | 100% | 17 ft | 138 stons |
| 3¾ | 10 in | 67% | 6 ft | 148 stons |
| MBL = 655 t | 24 in | 92% | 9 ft | 149 stons |
| | 48 in | 98% | 13 ft | 151 stons |
| | 72 in | 100% | 17 ft | 153 stons |
| TREE LANDING - MARIANAS - APRIL - HEAD SEAS | | | | |
| 2¼ | 10 in | 37% | 3 ft | 74 stons |
| MBL = 236 t | 24 in | 75% | 6 ft | 76 stons |

-continued

| Marianas Semi-submersible | | | | |
|---|---|---|---|---|
| | 48 in | 96% | 10 ft | 78 stons |
| 2¾ | 10 in | 73% | 5 ft | 94 stons |
| MBL = 352 t | 24 in | 89% | 7 ft | 96 stons |
| | 48 in | 98% | 11 ft | 98 stons |
| 3¼ | 10 in | 75% | 6 ft | 120 stons |
| MBL = 492 t | 24 in | 92% | 9 ft | 120 stons |
| | 48 in | 98% | 12 ft | 122 stons |
| 3½ | 10 in | 75% | 6 ft | 135 stons |
| MBL = 570 t | 24 in | 92% | 9 ft | 135 stons |
| | 48 in | 98% | 12 ft | 136 stons |
| 3¾ | 10 in | 75% | 6 ft | 149 stons |
| MBL = 655 t | 24 in | 94% | 10 ft | 149 stons |
| | 48 in | 99% | 12 ft | 151 stons |
| TREE LANDING - MARIANAS - MAY - HEAD SEAS | | | | |
| 2¼ | 10 in | 56% | 3 ft | 74 stons |
| MBL = 236 t | 24 in | 90% | 6 ft | 76 stons |
| | 48 in | 100% | 11 ft | 78 stons |
| 2¾ | 10 in | 89% | 5 ft | 94 stons |
| MBL = 352 t | 24 in | 98% | 8 ft | 96 stons |
| | 48 in | 100% | 12 ft | 97 stons |
| 3¼ | 10 in | 90% | 6 ft | 120 stons |
| MBL = 492 t | 24 in | 98% | 9 ft | 120 stons |
| | 48 in | 100% | 13 ft | 122 stons |
| 3½ | 10 in | 90% | 6 ft | 134 stons |
| MBL = 570 t | 24 in | 98% | 9 ft | 134 stons |
| | 48 in | 100% | 13 ft | 136 stons |
| 3¾ | 10 in | 90% | 6 ft | 148 stons |
| MBL = 655 t | 24 in | 98% | 10 ft | 149 stons |
| | 48 in | 100% | 13 ft | 150 stons |
| TREE LANDING - MARIANAS - FEBRUARY - BEAM SEAS | | | | |
| 2¼ | 10 in | 35% | 3 ft | stons |
| MBL = 236 t | 24 in | 62% | 5 ft | stons |
| | 48 in | 99% | 13 ft | 73 stons |
| 2¾ | 10 in | 20% | 3 ft | 90 stons |
| MBL = 352 t | 24 in | 64% | 5 ft | 94 stons |
| | 48 in | 99% | 16 ft | 97 stons |
| 3¼ | 10 in | 54% | 5 ft | 116 stons |
| MBL = 492 t | 24 in | 98% | 13 ft | 121 stons |
| | 48 in | 100% | 20 ft | 122 stons |
| 3½ | 10 in | 64% | 6 ft | 130 stons |
| MBL = 570 t | 24 in | 98% | 13 ft | 135 stons |
| | 48 in | 100% | 20 ft | 136 stons |
| 3¾ | 10 in | 67% | 6 ft | 146 stons |
| MBL = 655 t | 24 in | 99% | 13 ft | 150 stons |
| | 48 in | 100% | 20 ft | 151 stons |

| Synthetic Rope Diameter (in) | Maximum vertical Motion (single amp) | Percentage of time below threshold | Max sea-state | Max line tension |
|---|---|---|---|---|
| TREE LANDING MARIANAS - FEBRUARY - HEAD SEAS | | | | |
| 2 1/3 | 10 in | 36% | 3 ft | 33 stons |
| MBL = 168 t | 24 in | 64% | 5 ft | 33 stons |
| (Dyneema) | 48 in | 87% | 8 ft | 34 stons |
| | 72 in | 97% | 11 ft | 35 stons |
| 2½ | 10 in | 35% | 3 ft | 33 stons |
| MBL = 211 t | 24 in | 64% | 5 ft | 34 stons |
| (Dyneema) | 48 in | 87% | 8 ft | 35 stons |
| | 72 in | 97% | 11 ft | 36 stons |
| 2⅔ | 10 in | 35% | 3 ft | 33 stons |
| MBL = 234 t | 24 in | 64% | 5 ft | 34 stons |
| (Dyneema) | 48 in | 87% | 8 ft | 35 stons |
| | 72 in | 97% | 11 ft | 37 stons |
| 2⅝ | 10 in | 35% | 3 ft | 33 stons |
| MBL = 262 t | 24 in | 64% | 5 ft | 34 stons |
| (Dyneema) | 48 in | 88% | 8 ft | 36 stons |
| | 72 in | 97% | 11 ft | 37 stons |
| 4½ | 10 in | 86% | 8 ft | 39 stons |
| MBL = 165 t | 24 in | | | |
| (Polyester) | 48 in | | | |
| | 72 in | | | |

| Sea Sorceress and Chouest Vessels | | | | |
|---|---|---|---|---|
| Steel Wire Diameter (in) | Maximum vertical Motion (single amp) | Percentage of time below threshold | Max sea-state | Max line tension |
| TREE LANDING - SEA SORCERESS - FEBRUARY - QUARTERING SEAS | | | | |
| 3⅝ MBL = 650 t | 10 in | 41% | 4 ft | 129 stons |
| | 24 in | 73% | 7 ft | 131 stons |
| | 48 in | 96% | 11 ft | 132 stons |
| 4½ MBL = 165 t (Polyester) | 10 in | 65% | 5 ft | 40 stons |
| Polyester Diameter (in) | Maximum vertical Motion (single amp) | Percentage of time below threshold | Max sea-state | Max line tension |
| TREE LANDING - CHOUEST ROSS - FEBRUARY - HEAD SEAS | | | | |
| 4½ MBL = 165 t | 10 in | 35% | 3 ft | 40 stons |
| 4½ softened system | 10 in | 64% | 5 ft | 40 stons |

Although the present invention and its advantages have been described in detail, it should be understood that various changes, substitutions, and alterations could be made herein without departing from the spirit and scope of the invention as defined by the appended claims.

What is claimed is:

1. A method for positioning a subsea work package at a desired deepwater offshore location comprising:

launching a parking pile from a transport vessel;

lowering said pile to the sea floor with a hoisting line;

releasing the pile from the hoisting line such that the pile partially embeds itself into the sea floor;

launching the subsea work package from a transport vessel;

lowering the subsea work package to the sea floor with a combination of wire, chain, clump weights, subsurface buoys, and synthetic line; and parking the subsea work package on the embedded pile.

2. The method of claim 1, further comprising:

moving the parked subsea work package to an operating location.

3. A method for positioning a subsea work package at a desired deepwater offshore location comprising:

mounting the subsea work package to a parking pile;

launching the parking pile and subsea package from a transport vessel;

lowering said pile and package to the sea floor with a hoisting line; and releasing the pile and package from the hoisting line such that the pile partially embeds itself into the sea floor.

4. The method of claim 3, further comprising:

providing a protective frame to surround the mounted subsea work package.

5. The method of claim 4, further comprising:

removing the protective frame surrounding the parked subsea work package; and moving the parked subsea work package to an operating location.

6. The method of claim 3, further comprising:

providing a launching frame for launching the parking pile and subsea package from the transport vessel.

7. The method of claim 3, further comprising:

moving the parked subsea work package to an operating location.

* * * * *